US010100503B2

(12) United States Patent
Sakai et al.

(10) Patent No.: US 10,100,503 B2
(45) Date of Patent: Oct. 16, 2018

(54) FLUSH TOILET

(71) Applicant: TOTO LTD., Kitakyushu-shi, Fukuoka (JP)

(72) Inventors: Hirokazu Sakai, Kitakyushu (JP); Takaaki Kuwahara, Kitakyushu (JP); Teiji Nakamura, Kitakyushu (JP); Ayako Habu, Kitakyushu (JP); Koichiro Matsushita, Kitakyushu (JP); Haruo Tsutsui, Kitakyushu (JP); Takashi Yoshioka, Kitakyushu (JP); Koichi Takayama, Kitakyushu (JP); Hirotaka Shiokama, Kitakyushu (JP); Hiroshi Yuki, Kitakyushu (JP); Satoshi Kato, Kitakyushu (JP)

(73) Assignee: Toto Ltd. (JP)

( * ) Notice: Subject to any disclaimer, the term of this patent is extended or adjusted under 35 U.S.C. 154(b) by 0 days.

(21) Appl. No.: 15/408,216

(22) Filed: Jan. 17, 2017

(65) Prior Publication Data

US 2017/0211263 A1 Jul. 27, 2017

(30) Foreign Application Priority Data

Jan. 22, 2016 (JP) ..... 2016-010423
Jun. 9, 2016 (JP) ..... 2016-115304

(51) Int. Cl.
*E03D 1/33* (2006.01)
*E03D 1/26* (2006.01)

(52) U.S. Cl.
CPC ..... *E03D 1/33* (2013.01); *E03D 1/26* (2013.01)

(58) Field of Classification Search
CPC .... E03D 1/26; E03D 1/32; E03D 1/33; F16K 31/34
See application file for complete search history.

(56) References Cited

U.S. PATENT DOCUMENTS 4,080,986 A * 3/1978 Schoepe ..... E03D 1/33 137/426
9,745,729 B2 * 8/2017 Yamasaki ..... E03D 1/33
2010/0293706 A1 * 11/2010 Tsung-Yi ..... E03D 1/32 4/366
2013/0198944 A1 * 8/2013 Liu ..... E03D 1/00 4/415
2014/0048157 A1 * 2/2014 Fu ..... E03D 1/32 137/409
2016/0168834 A1 * 6/2016 Magar ..... E03D 1/32 137/434
2017/0002555 A1 * 1/2017 Liu ..... E03D 1/32
2017/0002946 A1 * 1/2017 Liu ..... E03D 1/32

FOREIGN PATENT DOCUMENTS

JP 2001-323540 A 11/2001
JP 2010-236202 A 10/2010

* cited by examiner

*Primary Examiner* — J. Casimer Jacyna
(74) *Attorney, Agent, or Firm* — Baker & Hostetler LLP

(57) ABSTRACT

A float rise speed control tank in a flush toilet is formed so that when the flush water level inside a flush water tank rises and the flush water level reaches a window due to supply of flush water into the flush water tank by a water supply device, the inflow into the float rise speed control tank by flush water in the flush water tank from a window formed above the bottom edge part of the float causes the rise speed of the flush water level in the float rise speed control tank to increase more than the rise speed of the flush water in the flush water tank.

11 Claims, 15 Drawing Sheets

FLUSH TOILET

TECHNICAL FIELD

The present invention relates to a flush toilet, and more particularly to a flush toilet for discharging waste by flushing with flush water.

BACKGROUND

For some time, as shown in Patent Document 1, float switches have been known in which the float switch is disposed on the upper portion inside a reservoir tank for supplying flush water to a flush toilet, such that when the water level reaches a full level during water supply, the float switch senses that the flush water level has reached the full level and causes supply of flush water to be stopped.

As shown in Patent Document 1 (Japanese Patent Unexamined Publication No. 2010-236202) and Patent Document 2 (Japanese Patent Unexamined Publication No. 2001-323540), a float switch for detecting the water level in a reservoir tank comprises a base portion attached to the reservoir tank, a support shaft extending from the base portion, and a float for moving up and down along this support shaft.

However, in the above-described conventional float switch, the problem arose that motion of the float, which is movable along the support shaft, could become unstable, such that the flush water level could not be reliably sensed.

For example, if the float switch and the support shaft are in a static state while in contact, the problem may arise that a static frictional force is produced between the float switch float and the support shaft, such that the float does not move relative to the support shaft even if the flush water level reaches the full level during water supply, resulting in non-activation of the float switch, or delay in the activation timing thereof. Another potential problem occurs when air bubbles adhere to the float switch float or the support shaft, interfering with the movement of the float, such that the flush water level during water supply fails to move relative to the support shaft, and the float switch is not activated, or the activation timing thereof is delayed.

SUMMARY

The present invention was undertaken to resolve the above-described problems with the conventional art, and has the object of providing a flush toilet capable of restraining the phenomenon whereby movement by the float along the shaft is impeded, notwithstanding a rising flush water level, such that the float switch fails to operate at the appropriate timing, delaying the timing at which the supply of water is stopped; the float switch can therefore be reliably operated, and the supply of water can be reliably stopped.

To accomplish the aforementioned object, the present invention is a flush toilet for discharging waste by flushing with flush water, the flush toilet comprising: a toilet main body; a flush water tank configured to store flush water to flush the toilet main body; a water supply device configured to supply flush water into the flush water tank; a float switch disposed in the flush water tank, the float switch including: a shaft disposed in the flush water tank; and a float configured to move up and down along the shaft in response to a rise or drop of a flush water level; and the float switch being configured to issue a stop water supply signal when the float rises to a predetermined position along the shaft in response to a rise of the flush water level; a control device configured to control to stop supplying the flush water by the water supply device after receiving the stop water supply signal issued by the float switch; and a float rise speed control tank disposed in the flush water tank, the float rise speed tank being configured to surround an outside of at least a lower portion of the float; wherein the float rise speed control tank includes a drain hole and a window; and the float rise speed control tank is configured to increase a rise speed of the flush water level in the float rise speed control tank more than a rise speed of the flush water level in the flush water tank when the flush water is supplied into the flush water tank by the water supply device and the flush water level in the flush water tank rises and reaches the window so that the flush water in the flush water tank flows into the float rise speed control tank through the window.

According to the invention thus constituted, the float rise speed control tank is formed so that when the flush water level in the flush water tank rises during water supply and reaches the windows, flush water inside the flush water tank flows into the float rise speed control tank from the windows formed above the bottom edge part of the float. The rise speed of the flush water level inside the float rise speed control tank is increased more than the rise speed of the flush water level inside the flush tank. The float is therefore subjected to a buoyancy force, which is increased in response to the increased water level rise speed. Hence even if the float switch float is subjected to forces acting to impede its movement, such as the occurrence of static frictional force relative to the shaft or the adherence of bubbles, buoyancy acting on the float is increased to the point that it overcomes the force acting to impede movement between the float and the shaft, thus making it easier for the float to rise relative to the shaft. Hence the phenomenon whereby movement by the float along the shaft is impeded, notwithstanding a rising flush water level, such that the float switch fails to operate at the appropriate timing, delaying the timing at which the supply of water is stopped, can be constrained.

Also, because flush water drops into the float rise speed control tank from the window formed on the upper side of the float when the flush water level reaches the window during supply of water, turbulence is generated in the water surface; this shakes the float such that the float receives a force large enough to overcome the static frictional force between the float and the shaft so that the static frictional force between the float and the shaft is more easily released, and the float can be more easily made to rise relative to the shaft. Hence the phenomenon whereby movement by the float along the shaft is impeded, notwithstanding a rising flush water level, such that the float switch fails to operate at the appropriate timing, delaying the timing at which the supply of water is stopped, can be constrained.

Therefore the float switch can be reliably activated, and the supply of water reliably stopped.

In the present invention, preferably, the windows on the float rise speed control tank are formed at approximately a same height position to each other.

According to the invention thus constituted, when the flush water level inside the flush water tank rises during supply of water and reaches the window, inflow of flush water into the flush water tank all at once from the window formed at approximately the same height position as the float rise speed control tank is started at approximately the same timing. Hence the rise speed of the flush water level inside the float rise speed control tank is increased more than the rise speed of the flush water level inside the flush tank.

Therefore the float can receive a further increased buoyancy force in response to the further increased water level rise speed.

In the present invention, preferably, the windows on the float rise speed control tank are formed over approximately an entire circumference of the float rise speed control tank.

According to the invention thus constituted, when the flush water level inside the flush water tank rises during supply of water and reaches the window, inflow of flush water into the flush water tank from the window formed over essentially the entire circumference of the float rise speed control tank into the float rise speed control tank is all at once started from essentially the entire circumference. Hence the rise speed of the flush water level inside the float rise speed control tank is increased more than the rise speed of the flush water level inside the flush tank. Therefore the float can receive a further increased buoyancy force in response to the further increased water level rise speed.

In the present invention, preferably, a drain hole float is provided on the drain hole on the float rise speed control tank, the drain hole float being configured to close off the drain hole by using a buoyancy which the drain hole float receives when the flush water level in the flush water tank rises.

According to the invention thus constituted, the drain hole float closes off the drain hole due to the buoyancy it receives from the rising of the flush water level, therefore flush water can be prevented from flowing out of the drain hole into the float rise speed control tank until the flush water level in the flush water tank rises and reaches the window.

Flush water can thus be made to flow all at once from the windows into an empty float rise speed control tank, and the speed at which the flush water level in the float rise speed control tank rises can be made to increase faster than the speed at which the flush water level in the flush water tank rises, and the float can be subjected to an increased buoyancy in response to the increased level rising speed.

Also, because flush water drops into the essentially empty float rise speed control tank from the window formed on the upper side of the bottom edge part of the float when the flush water level reaches the window during supply of water, turbulence is generated in the water surface; this shakes the float such that the float receives a force large enough to overcome this static frictional force between the float and the shaft, so that the static frictional force between the float and the shaft is more easily released, and the float can be more easily made to rise relative to the shaft.

In the present invention, preferably, the rise speed of the flush water level inside the float rise speed control tank is set to a range from 7 mm/s to 100 mm/s.

According to the present invention thus constituted, the rise speed of the flush water level inside the float rise speed control tank is set to a range from 7 mm/s to 100 mm/s. Therefore the float can be acted upon by a further increased buoyancy corresponding to a water level rise speed of 7 mm/s to 100 mm/s.

In the invention, preferably, the drain hole is formed on a bottom of the float rise speed control tank, the drain hole having a size in a range of 1 mm to 15 mm in diameter.

According to the invention thus constituted, the drain hole has a diameter in the range of 1 mm to 15 mm, therefore during descent of the flush water level associated with discharge of flush water in the flush water tank, the flush water inside the float rise speed control tank is arranged to flow out into the flush water tank, in full or essentially in full, from the drain hole; furthermore when water is being supplied to the flush water tank, the amount of flush water flowing into the float rise speed control tank from the drain hole is held to a relatively small amount, at a position lower than the bottom edge part of the float, until the level of flush water around the float rise speed control tank reaches the window. Therefore flush water can be made to flow all at once from the window into a float rise speed control tank in a relatively low water level state, and the speed at which the flush water level in the float rise speed control tank rises can be made to increase faster than the speed at which the flush water level in the flush water tank rises, and the float can be subjected to an increased buoyancy in response to the increased level rising speed.

Also, because flush water drops into the float rise speed control tank in a relatively low water level state from the window formed on the upper side of the bottom edge part of the float when the flush water level reaches the window during supply of water, turbulence is generated in the water surface; this shakes the float such that the float receives a force large enough to overcome this static frictional force between the float and the shaft, so that the static frictional force between the float and the shaft is more easily released, and the float can be more easily made to rise relative to the shaft.

In the present invention, preferably, the float rise speed control tank further includes a deflector extending outward and diagonally downward from a bottom edge of the window.

According to the invention thus constituted, because the deflector extends diagonally downward and outward from the bottom edge of the window, even if small objects such as floating objects in the flush water tank are present along the lower outer wall surface of the float rise speed control tank window due to surface tension, small objects rising with the rise in water level inside the flush water tank can be caught by the deflector so they do not rise from below the window up to the height of the window. Therefore small objects present at positions along the outer wall surface below the float rise speed control tank window can be restrained from penetrating into the float rise speed control tank window.

When the flush water level inside the flush water tank rises gradually at the deflector height, the deflector extends outward and diagonally downward from the bottom edge of the window, therefore a relatively large surface tension can be prevented from occurring between the horizontal flush water surface and the top surface of the diagonally downwardly extending deflector. Delays or variability in the timing at which flush water flows into the window from the top surface of the deflector caused by the effects of surface tension can thus be restrained, and the problem of delays in the timing at which the water level inside the float rise speed control tank rises can be reduced so that precision of float switch activation timing can be maintained.

In the present invention, preferably, the float rise speed control tank is disposed on a center area side of the flush water tank.

According to the invention thus constituted, small objects such as debris or floating objects, etc. in the flush water tank can be easily collected on the flush water tank inside wall surface by surface tension. Therefore by disposing the float rise speed control tank on a center area side of the flush water tank, small objects such as debris or floating objects, etc. collected on the inside wall surface of the flush water tank can be restrained from penetrating into the window at the center region side of the flush water tank.

In the present invention, preferably, the float rise speed control tank further includes a deflector extending outward from a bottom edge of the window.

According to the invention thus constituted, because the deflector extends outward from the bottom edge of the window, even when small objects such as floating objects in the flush water tank are present along the lower outer wall surface of the float rise speed control tank window due to surface tension, small objects rising with the rise in water level inside the flush water tank can be caught by the deflector so they do not rise from below the window up to the height of the window. Therefore small objects present at positions along the outer wall surface below the float rise speed control tank window can be restrained from penetrating into the float rise speed control tank window.

In the present invention, preferably, the float rise speed control tank further includes a deflector extending outward and diagonally downward from a bottom edge of the window.

According to the invention thus constituted, because the deflector extends diagonally downward and outward from the bottom edge of the window, even when small objects such as floating objects in the flush water tank are present along the lower outer wall surface of the float rise speed control tank window due to surface tension, small objects rising with the rise in water level inside the flush water tank can be caught by the deflector so they do not rise from below the window up to the height of the window. Therefore small objects present at positions along the outer wall surface below the float rise speed control tank window can be restrained from penetrating into the float rise speed control tank window.

When the flush water level inside the flush water tank rises gradually at the deflector height, the deflector extends outward and diagonally downward from the bottom edge of the window, therefore a relatively large surface tension can be prevented from occurring between the horizontal flush water surface and the top surface of the diagonally downwardly extending deflector. Delays or variability in the timing at which flush water flows into the window from the top surface of the deflector caused by the effects of surface tension can thus be restrained, and the problem of delays in the timing at which the water level inside the float rise speed control tank rises can be reduced so that precision of float switch activation timing can be maintained.

In the present invention, preferably, the float rise speed control tank is provided with an attachment opening portion attached to the shaft of the float at a bottom portion of the float rise speed control tank; and the attachment opening portion includes a tilt suppressing portion configured to suppress tilt of the float rise speed control tank relative to the shaft.

According to the invention thus constituted, the attachment opening portion on the float rise speed control tank comprises a tilt restraining portion for restraining the tilt of the float rise speed control tank relative to the shaft while attached to the shaft, therefore the tilt of the float rise speed control tank can be held essentially horizontal, sloping of the flush water level in the float rise speed control tank can be restrained, and float switch activation timing can be precisely maintained.

In the present invention, preferably, the float rise speed control tank includes: an opening and closing mechanism configured to open and close the drain hole, the opening and closing mechanism having a closed orientation in which the drain hole is closed off by a seal; and an open orientation in which the drain hole is opened by moving the seal diagonally from the closed orientation; and the opening and closing mechanism further includes: a support arm configured to support a seal; and a drain hole float for causing buoyancy to act on the seal; a support arm attaching portion configure to attach the support arm; and a raised portion configured to project toward a gap between the support arm and the support arm so as to suppress contact between the support arm and the support arm attaching portion.

According to the invention thus constituted, the float rise speed control tank opening and closing mechanism has an open orientation for opening the drain hole to a relatively large extent by causing the seal portion to move diagonally from a closed orientation, therefore the drain hole can be released to a relatively large extent, and small objects such as floating objects which have entered the float rise speed control tank can be made less prone to become lodged in the drain hole, and can be discharged from the drain hole into the flush water tank with a relatively large flow volume of flush water. Hence even if small objects enter into the float rise speed control tank, float switch operational failures and blockage of the drain hole can be restrained, and reliability of the float rise speed control tank can be improved.

In addition, because the raised portion restrains contact between the support arm and the support arm attaching portion, the support arm and the support arm attaching portion are affixed in a contacting state, so the occurrence of operational failures of the opening and closing mechanism can be restrained.

Hence the phenomenon whereby movement by the float along the shaft is impeded, notwithstanding a rising flush water level, such that the float switch fails to operate at the appropriate timing, delaying the timing at which the supply of water is stopped, can be constrained, so the float switch can be reliably operated, and supply of water can be reliably stopped.

DETAILED DESCRIPTION

Next, referring to the attached drawings, a flush toilet according to a first embodiment of the invention is explained.

First, using FIGS. 1 through 4, a flush toilet according to a first embodiment of the invention is explained.

Figure 1:
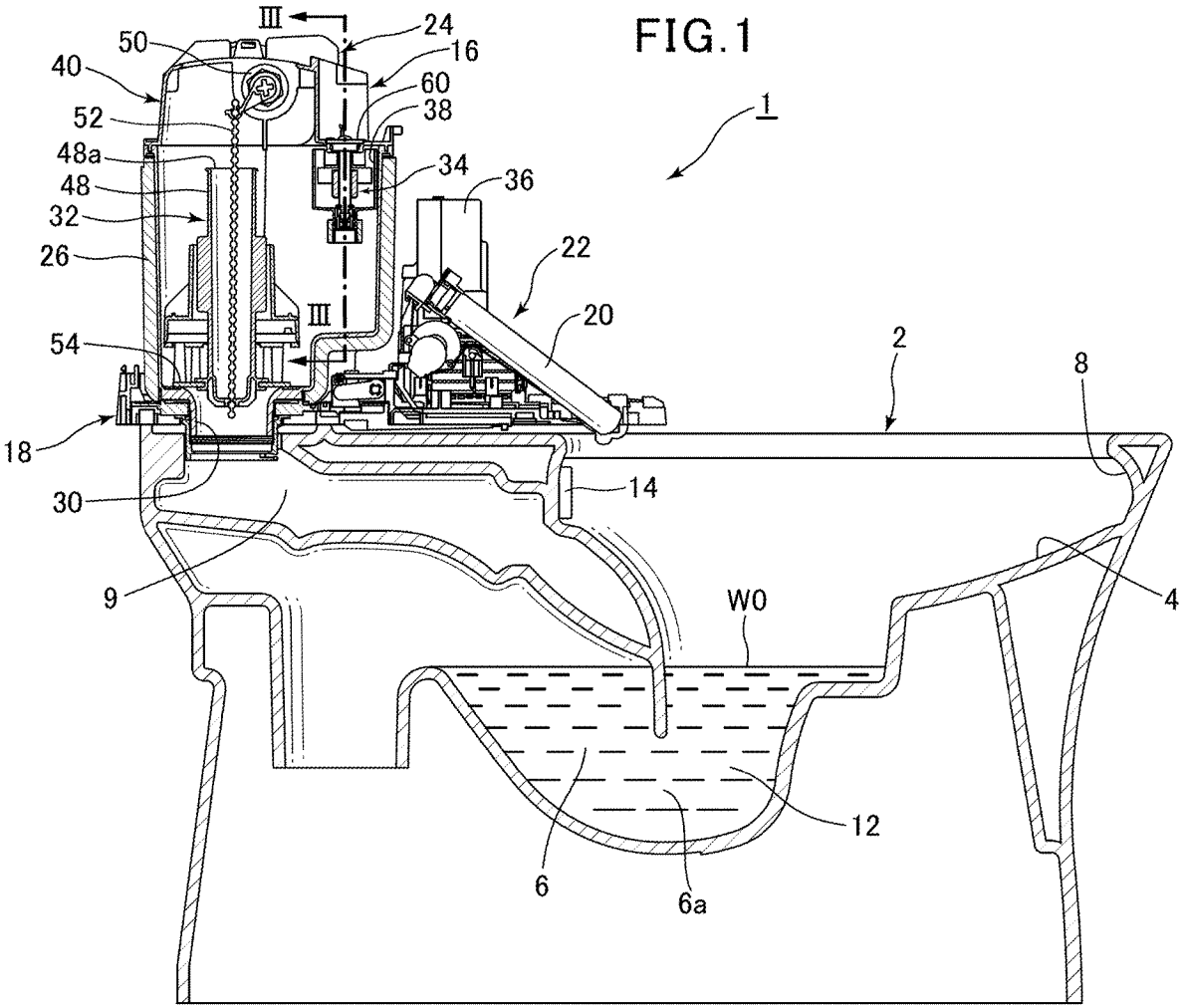
FIG. 1 is a cross sectional diagram showing a center cross section in the front-back direction of a flush toilet with the casing, toilet seat, and toilet lid omitted, in a flush toilet according to a first embodiment of the invention.
Figure 2:
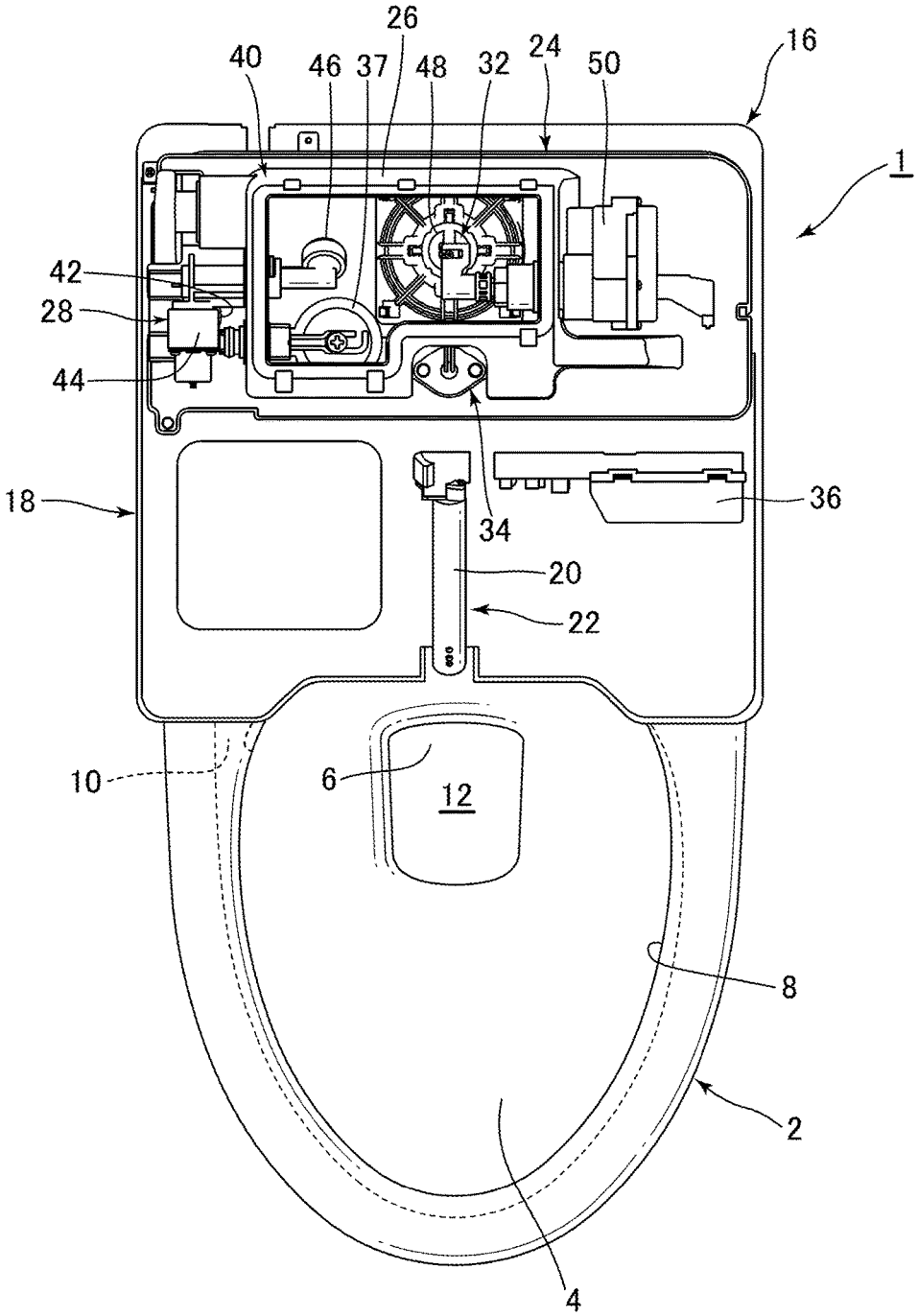
FIG. 2 is a top plan view showing a flush toilet with the casing, the inside cover body of the flush water tank device, and the toilet seat and toilet lid omitted, in a flush toilet according to a first embodiment of the invention.

FIG. 1 is a cross sectional diagram showing a center cross section in the front-back direction of a flush toilet with the casing, toilet seat, and toilet lid omitted, in a flush toilet according to a first embodiment of the invention; FIG. 2 is a top plan view showing a flush toilet with the casing, the inside cover body of the flush water tank device, and the toilet seat and toilet lid omitted, in a flush toilet according to a first embodiment of the invention.

As shown in FIGS. 1 through 4, reference numeral 1 is a flush toilet for discharging waste by flushing with flush water; this flush toilet 1 comprises a ceramic toilet main body 2; a toilet lid (not shown) disposed above the toilet main body 2, a toilet seat (not shown) disposed between the toilet lid (not shown) and the toilet main body 2 on the top surface of the toilet main body 2, a bowl portion 4, and a discharge trap pipe 6 communicating with the lower portion of this bowl portion 4 are respectively formed on this toilet main body 2. Note that in addition to ceramic, the toilet main body 2 may also be formed of resin and ceramic, or of resin alone.

An inward-overhanging rim 8 is formed on the top edge portion of the toilet main body 2 bowl portion 4; a first spout port 10 for spouting flush water supplied from a conduit 9 formed on the interior at the rear side of the toilet main body 2 is formed on the top left of the toilet main body 2 bowl portion 4, and flush water spouted from this first spout port 10 descends as it circulates, flushing the bowl portion 4.

A water accumulating portion 12, the accumulated water surface of which is shown by solid line W0, is formed at the lower part of the bowl portion 4. A discharge trap pipe 6 inlet 6*a* is opened at the bottom of this water accumulating portion 12, and the discharge trap pipe 6 to the rear of this inlet 6*a* is connected to a discharge pipe (not shown) through a discharge socket (not shown).

Also, a second spout port 14 for spouting flush water supplied from the conduit 9 formed inside the rear side of the toilet main body 2 is formed at a position above the rear right side of the accumulated water surface W0 in the bowl portion 4, and flush water spouted from this second spout port 14 produces a circulating flow which causes accumulated water in the water accumulating portion 12 to circulate in the up/down direction.

A flush unit 16 is disposed on the top surface at the rear side of the toilet main body 2.

The flush unit 16 comprises: a casing plate 18, disposed on the top surface at the rear side of the toilet main body 2 and forming the base portion of a flush unit 16, a human body private portion washing device 22 placed on the top surface of the casing plate 18 for activating the nozzle portion 20 to jet flush water for washing body parts, and a flush water tank device 24 for storing water supplied to the bowl portion 4.

The casing plate 18 is disposed to align the flush water tank device 24 and the private portion washing device 22 together in mutual proximity on the casing plate 18, storing them as a single unit inside a single casing cover (not shown).

Figure 3:
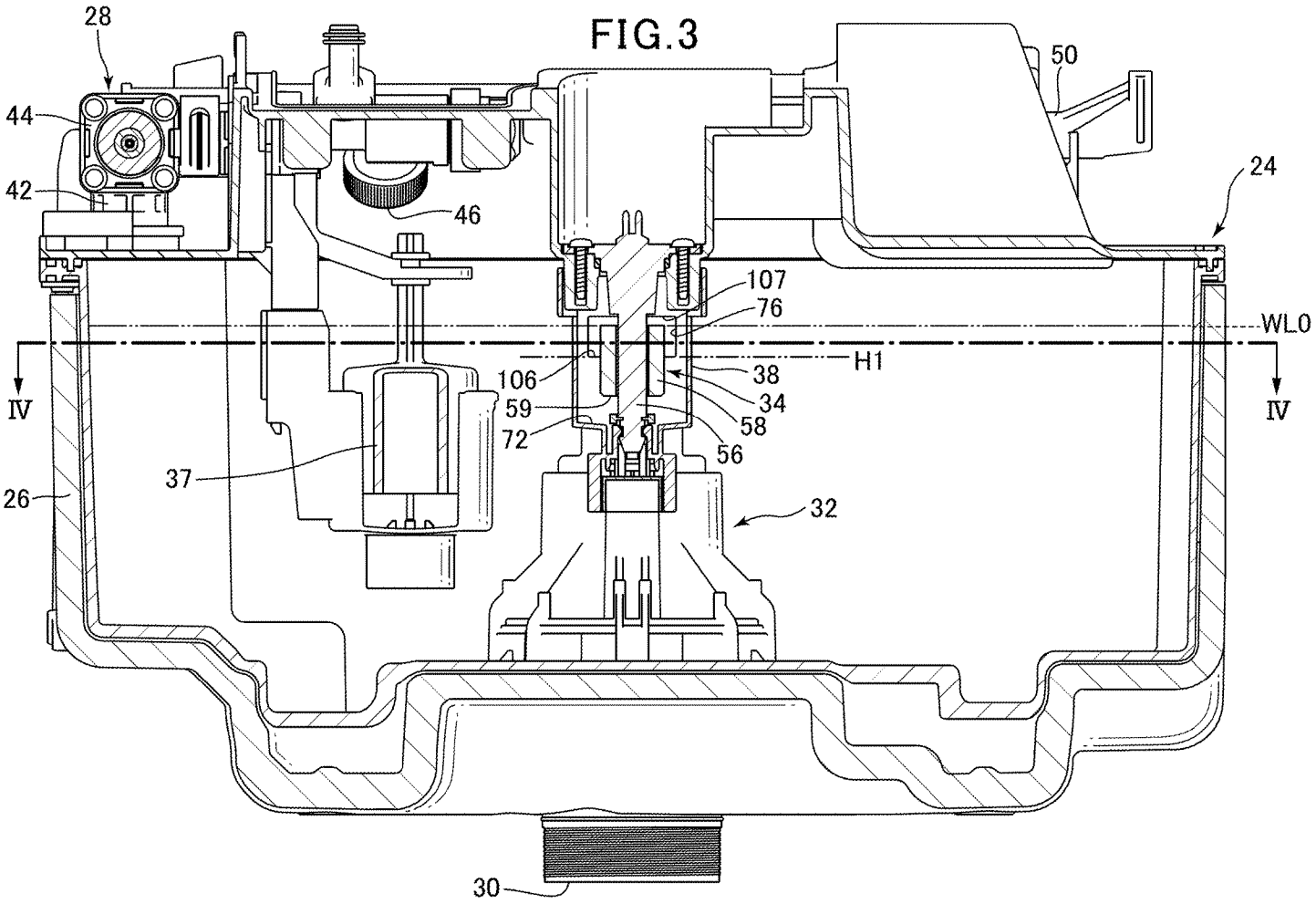
FIG. 3 is a cross sectional diagram viewed along line in FIG. 1.

As shown in FIGS. 1 and 3, the flush water tank device 24 is what is referred to as a low silhouette tank, which is formed to be relatively low in height, and stores water supplied to the bowl portion 4.

The flush water tank device 24 has: a flush water tank 26, being a flush water tank for storing flush water to flush the flush toilet 1; a water supply device 28, a portion of which is placed inside the flush water tank 26, for supplying flush water into the flush water tank from a water supply source such as municipal water, etc.; a discharge valve device 32 placed inside the flush water tank 26, for releasing the discharge port 30 to flush water stored in the flush water tank 26 and causing it to flow into the toilet main body 2 conduit 9; a float switch 34 placed on the top portion inside the flush water tank 26; a control device 36 for performing a control to stop the supply of flush water by the water supply device 28 by receiving a stop supply signal issued by the float switch 34; a power outage float 37 capable of stopping the supply operation by the water supply device 28 in a power outage; and a float rise speed control tank 38 formed on the inside of the flush water tank 26 and the outside of the float switch 34 so as to surround at least the lower portion of the float switch 34 from the outside.

A flush water tank cover 40 covering the upper opening on this flush water tank 26 is attached to the flush water tank 26. A discharge port 30 communicating with the toilet main body 2 conduit 9 is formed on the bottom portion of the flush water tank 26, and flush water in the flush water tank 26 is supplied through the discharge port 30 to the toilet main body 2 conduit 9.

As the water supply device 28 has the same constitution as a conventional water supply device, a detailed explanation thereof is here omitted, but it comprises: a water supply pipe 42 extending from the flush water tank 26 external water supply source to the water supply device 28, for supplying flush water at a predetermined supply pressure; a water supply valve 44 attached to the top edge of this water supply pipe 42, for switching the flush water supplied from the water supply pipe 42 between spouting and stopping water into the flush water tank 26; and a spout port 46, opening on the downstream side of the water supply valve 44, for spouting flush water from the water supply valve 44 into the flush water tank 26. The water supply device 28 is arranged to spout flush water at a predetermined quantity per unit time from the spout port 46 into the flush water tank 26. For example, the flush water supply flow volume per unit time by the water supply device 28 is in a range of 4 L/min to 10 L/min. At such time, the speed at which the flush water level inside the flush water tank 26 risers is set to a rise speed in a range of 1 mm/s to 4 m/s, for example to a rise speed of 2 mm/s.

Since the constitution of the discharge valve device 32 is the same as that of a conventional discharge valve device, a detailed explanation thereof is here omitted, but this discharge valve device 32 comprises an overflow tube 48 extending in the vertical direction, and a discharge valve 54 affixed to the bottom edge of the overflow tube 48; whereby the lower part within this overflow tube 48 communicates with the discharge port 30, and if the water level inside the flush water tank 26 by some chance rises higher than the full water level WL0 and reaches the overflow tube 48 top edge opening portion 48*a*, flush water which has flowed in from this overflow tube 48 top edge opening portion 48*a* is discharged from the discharge port 30 to the conduit 9 of the toilet main body 2.

When a user operates an operating switch (not shown) or the like attached to a wall, etc. to execute a predetermined large flush or small flush mode, and the drive device 50 is driven to pull the overflow tube 48 and the discharge valve 54 up via a bead chain 52, the discharge port 30 is released, and a predetermined quantity of flush water inside the flush water tank 26 is discharged to the conduit 9 of the toilet main body 2 until the discharge valve 54 drops and the discharge port 30 closes after the elapse of a predetermined time.

The control device 36 is capable of electrically controlling electronic components comprised of the flush water tank device 24 and the private portion washing device 22. For example, the control device 36 is electrically connected to the supply valve 44, the float switch 34, the discharge valve device 32 drive device 50, the private portion washing device 22 of the water supply device 28 of the flush water tank device 24, and the operating switches (not shown) for starting and stopping each operation, etc., and transmits and receives command signals required to operate each device. The control device 36 is disposed on the private portion washing device 22 side, but may also be disposed on the outside of the flush water tank 26 on the flush water tank device 24 side or the like.

The control device 36 performs controls to open the supply valve 44 of the water supply device 28 immediately after flush water discharge is started, thereby opening the supply valve 44 of the water supply device 28 and starting the supply of flush water. As a variant example, when a predetermined time has elapsed after start of flush water discharge, or when the control device 36 has receive a supply water start signal issued when the lower portion float switch (not shown) separately installed in the flush water tank senses a drop in the water level, the control device 36 can implement a control to open the water supply device 28 water supply valve 44, or to start supply of flush water.

In the present embodiment, the control device 36 performs controls to stop the supply of flush water by closing off the supply valve 44 of the water supply device 28 when a water supply stop signal sent by the float switch 34 is received.

Also, when a user operates an operating switch (not shown) attached to a wall or the like, the control device 36 receives a flush start command signal or the like issued by the operating switch and performs a control so that a predetermined flush mode such as larger flush or small flush is executed, driving the drive device 50; i.e. the drive portion is rotated, lifting the bead chain 52, and in turn lifting the overflow tube 48 and discharge valve 54.

Next, referring to FIGS. 3 through 7, details of the float switch 34 according to a first embodiment of the invention are explained.

Figure 5:
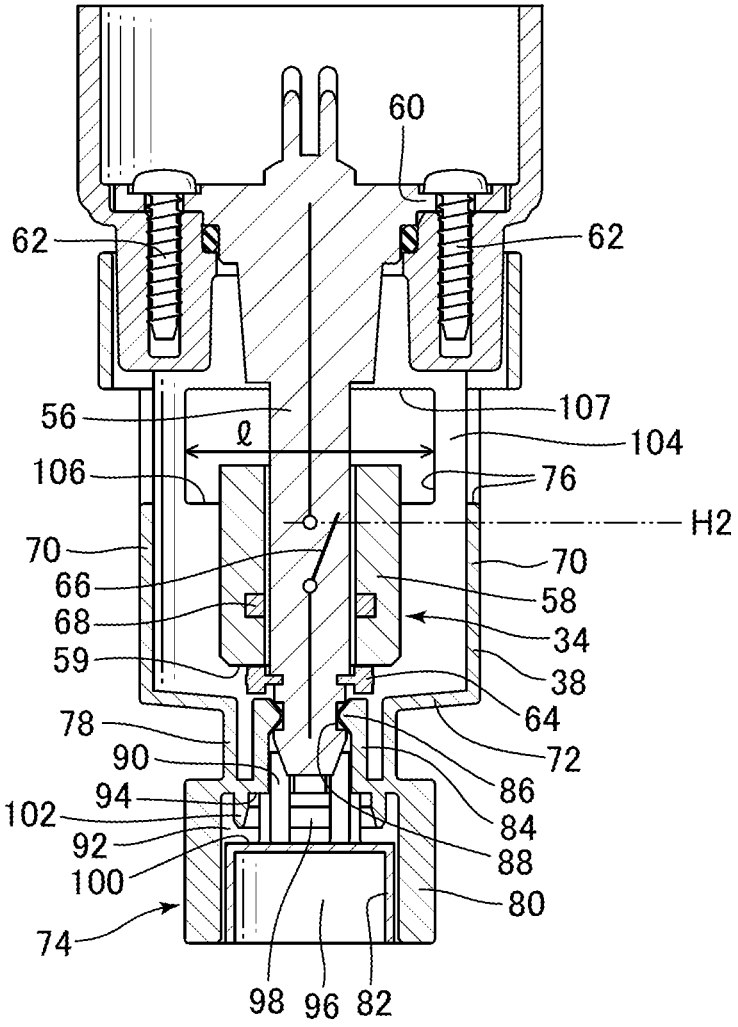
FIG. 5 is a partial expanded cross sectional diagram expanding the cross section in the left-right direction of the FIG. 3 float switch and float rise speed control tank, in which the flush water level inside the flush water tank device has descended and flush water is fully discharged from the float rise speed control tank, in a flush toilet according to a first embodiment of the invention.
Figure 6:
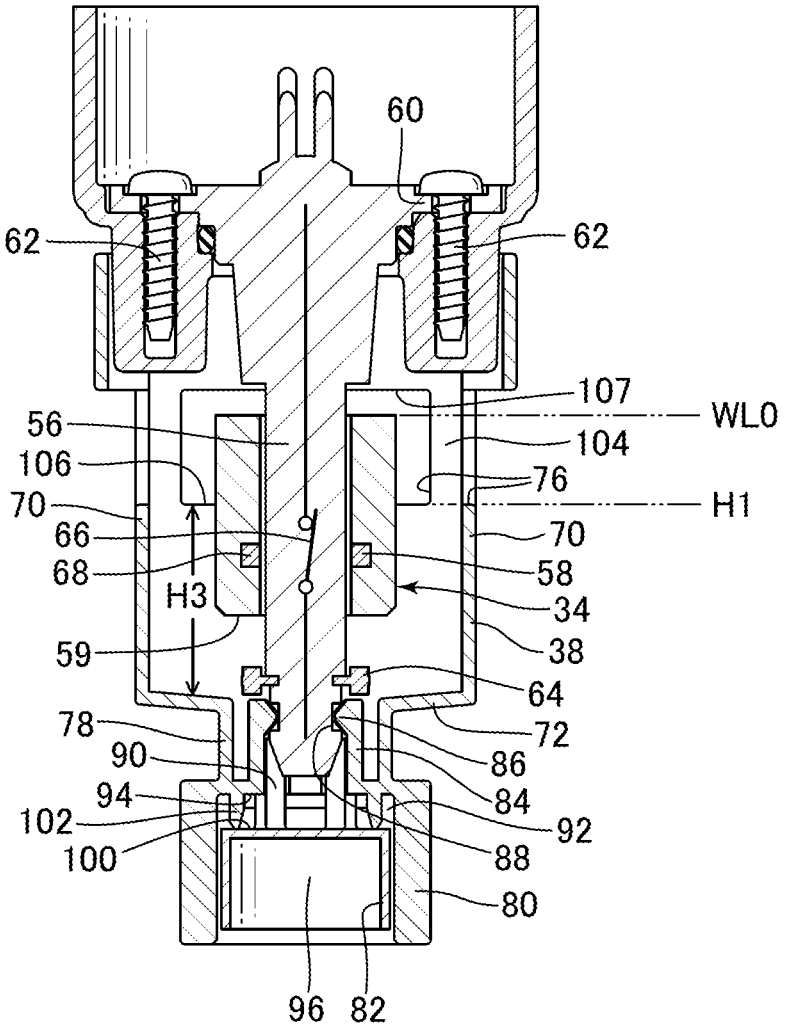
FIG. 6 is a partial expanded cross sectional diagram expanding the cross section in the left-right direction of the FIG. 3 float switch and float rise speed control tank, in which the flush water level inside the flush water tank device is full, in a flush toilet according to a first embodiment of the invention.
Figure 7:
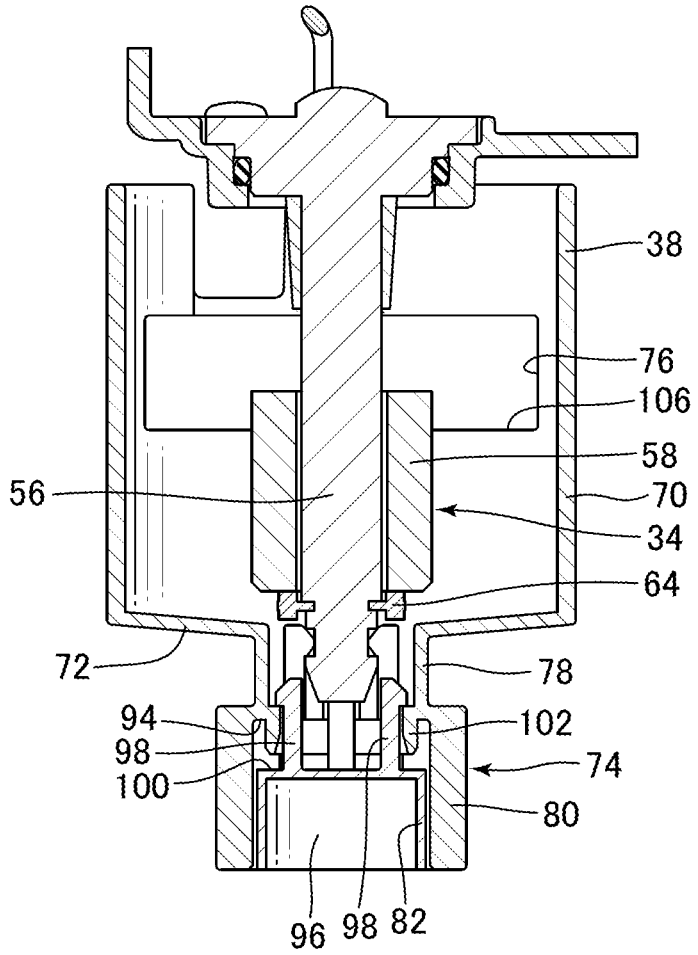
FIG. 7 is a partial expanded cross sectional diagram expanding the cross section in the front-back direction of the float switch and float rise speed control tank shown in FIG. 1, in which the flush water level inside the flush water tank device has descended and flush water is fully discharged from the float rise speed control tank, in a flush toilet according to a first embodiment of the invention.

FIG. 5 is a partial expanded cross sectional diagram expanding the cross section in the left-right direction of the FIG. 3 float switch and float rise speed control tank, in which the flush water level inside the flush water tank device has descended and flush water is fully discharged from the float rise speed control tank, in a flush toilet according to a first embodiment of the invention; FIG. 6 is a partial expanded cross sectional diagram expanding the cross section in the left-right direction of the FIG. 3 float switch and float rise speed control tank, in which the flush water level inside the flush water tank device is full, in a flush toilet according to a first embodiment of the invention; FIG. 7 is a partial expanded cross sectional diagram expanding the cross section in the front-back direction of the float switch and float rise speed control tank shown in FIG. 1, in which the flush water level inside the flush water tank device has descended, and flush water is fully discharged from the float rise speed control tank, in a flush toilet according to a first embodiment of the invention.

The float switch 34 comprises a stem (shaft) 56 forming a rod-shaped shaft on the float switch 34, and a float 58 which moves up and down along the stem 56 under water level-dependent buoyancy in response to changes in water level within the flush water tank 26.

The float switch 34 is attached to the top portion of the flush water tank 26 and to the inside thereof.

In addition, the float switch 34 is disposed on the inside of the float rise speed control tank 38.

As shown in FIGS. 5 through 7, the stem 56 is disposed to extend vertically downward so as to depend from the attaching portion 60 attached to the top portion of the flush water tank 26. In the attaching portion 60, it is attached by a screw 62. A float stop 64 is formed at a position slightly above the bottom edge of the stem 56. The float 58 is prevented by this float stop 64 from dropping off when it descends, and the float 58 standby position can be defined on the float stop 64 when the flush water level falls below the float stop 64.

The stem 56 comprises a reed switch 66 on the interior of the stem 56. The float switch 34 reed switch 66 is electrically connected to the control device 36. The reed switch 66 issues (transmits) a stop water supply signal to the control device 36 when ON. When OFF, the reed switch 66 is in the standby state and issues no stop water supply signal.

The float 58 is formed in a cylindrical shape, and the stem 56 is disposed to pass through the center space thereof. The float 58 is formed in a cylindrical shape with an outer edge diameter in a range of 15 mm to 25 mm. The float 58 is formed to have a ring-shaped horizontal cross section. Hence the float 58 can be freely moved up and down along the stem 56. The float 58 forms a tiny gap relative to the stem 56. Depending on its own position and orientation, etc., a portion of the float 58 contacts the stem 56. Normally the float 58 moves while continuing to be in contact with the stem 56.

When attempting to move the float 58 relative to and along the stem 56, the float 58 is subjected to a static frictional force (or dynamic friction force) relative to the stem 56, which acts to impede its movement. For example, if the float 58 is stopped while in a state of contact with the stem 56, the float 58 must be moved by a force capable of overcoming forces acting to impede movement, such as the static frictional force between the float 58 and the stem 56 and the adhesion of air bubbles, etc. (e.g., buoyancy, impact forces caused by water flow, or forces creating a wave force, such as water flow-induced pitching, surface turbulence, or the like). When forces less than or equal to the static frictional force (or dynamic frictional force) between the float 58 and the stem 56 act on the float 58, the float 58 may remain static relative to the stem 56, or the float 58 may change from a moving state to a static state relative to the stem 56, resulting in malfunctioning of the float switch 34, therefore such non-moving states must be prevented.

The float 58 is disposed so that a magnet 68 is embedded at an inside position on the lower portion thereof. The position of the magnet 68 therefore also moves with the up and down movement of the float 58. In the state shown in FIG. 5, the float 58 magnet 68 is separated from the reed switch 66. When the float 58 magnet 68 rises from the state shown in FIG. 5 and approaches the reed switch 66, the magnetic field produced by the magnet 68 is able to turn the reed switch 66 ON by exerting a strong magnetic field on the reed switch 66. In the state shown in FIG. 6, the float 58 magnet 68 is approaching the reed switch 66. If the float 58 magnet 68 descends from the state shown in FIG. 6 and separates from the reed switch 66, the magnetic field of the magnet 68 weakens in the reed switch 66, enabling the reed switch 66 to be placed in an OFF state.

Next, referring to FIGS. 3 through 7, details of a float rise speed control tank 38 in a flush toilet according to a first embodiment of the invention are explained. The float rise speed control tank 38 is formed to surround at least the lower portion of the float 58 on the inside of the flush water tank device 24 and the outside of the float 58.

The float rise speed control tank 38 is formed in a right angle parallelepiped shape. Hence the float rise speed control tank 38 is formed so that on the outside of the float 58, the sides of the right angle parallelepiped surround the perimeter of the upper and lower portions (including the bottom portion) of the float 58. The float rise speed control tank 38 may be formed not only as a right angle parallelepiped, but also in a cylindrical or other shape.

The float rise speed control tank 38 comprises: a vertical wall 70 formed on the outside of the float 58 and extending vertically; a bottom portion 72 extending inside from the bottom edge of the vertical wall 70 and formed to surround the lower portion (including the bottom portion) of the float 58; a drain portion 74 forming a drain hole for draining water in that bottom portion 72; and a window 76 formed in the vertical wall 70 in a region on the upper side of the bottom edge part 59 of the float 58.

The vertical walls 70 form the four flat wall surface sides of the right angle parallelepiped float rise speed control tank 38. The bottom portion 72 forms the bottom surface of the right angle parallelepiped float rise speed control tank 38, and this bottom surface slopes downward toward the drain portion 74.

The float rise speed control tank 38 drain portion 74 is formed as an opening portion communicating between the inside and outside of the float rise speed control tank 38 at the bottom surface of the float rise speed control tank 38. The drain portion 74 comprises a first cylindrical portion 78 extending downward from the float rise speed control tank 38 bottom portion 72 and forming a water draining flow path on the inside; a second cylindrical portion 80 extending downward from the bottom edge of the first cylindrical portion 78 and forming a water draining flow path on the inside; and a drain hole float 82 for blocking the flow path inside the drain portion 74 using the buoyancy imparted to it by the rise of the flush water level.

The first cylindrical portion 78 and the second cylindrical portion 80 are integrally formed with the bottom portion 72 and the vertical walls 70 of the float rise speed control tank 38 so as to extend downward from the center of the float rise speed control tank 38 bottom portion. Note that the first cylindrical portion 78 and the second cylindrical portion 80 are respectively formed as separate bodies from each part of the float rise speed control tank 38.

The first cylindrical portion 78 is formed in a cylindrical shape, and on its interior forms a flush water flow path for communicating between the inside and the outside of the float rise speed control tank 38.

The first cylindrical portion 78 forms on its inside a cylindrically shaped region in which a snap affixing portion 86 and a drain hole float support portion 99, discussed below, can be disposed.

The first cylindrical portion 78 comprises a snap affixing portion 86 formed on the tip of a snap affixing support portion 84 extending upward in the longitudinal direction after extending a predetermined distance toward the interior from the bottom surface of the perimeter wall thereof, and the snap affixing portion 86 engages a channel portion 88 formed at the lower portion of the stem 56. Engagement with the channel portion 88 at the lower portion of the stem 56 by the snap affixing portion 86 enables the edge of the float switch 34 stem 56 to be affixed close to the bottom portion of the float rise speed control tank 38, so that the float switch 34 can be reliably affixed and its orientation stabilized so as to operate correctly.

The second cylindrical portion 80 is formed in a cylindrical shape, and on its interior forms a flush water flow path for communicating between the inside and the outside of the float rise speed control tank 38. The second cylindrical portion 80 and the first cylindrical portion 78 share a common center axis line, and the second cylindrical portion 80 has a larger radius than the first cylindrical portion 78. Hence a ring-shaped flat portion 94 is formed close to the joining region between the first tubular internal flow path 90 formed on the interior of the first cylindrical portion 78 and the second tubular internal flow path 92 formed on the interior of the second cylindrical portion 80. The second cylindrical portion 80 is disposed so that the drain hole float 82 can be moved up and down on the inside thereof.

The drain hole float 82 has a cylindrical shape; a cylindrical interior space 96 is formed on the inside thereof, and the interior space 96 is opened downward and is formed in a cap shape similar to a bottle cap.

The drain hole float 82 extends upward from this top surface, and comprises a float snap portion 98, on the tip of which a snap (claw shaped portion) is formed. The float snap portion 98 is arranged to engage with a drain hole float support portion 99 projecting on the inside of the first cylindrical portion 78; when the drain hole float 82 is fully descended, the float snap portion 98 and the drain hole float support portion 99 engage, and the drain hole float 82 is supported in a suspended state. In addition, when the water level inside the flush water tank 26 has risen, the drain hole float 82 float snap portion 98 separates from the drain hole float support portion 99 and rises, the drain hole float 82 is raised and, as described below, a flow path through which flush water can pass is formed between the first cylindrical portion 78 and the second cylindrical portion 80.

The drain hole float 82 is arranged to rise due to buoyancy as flush water rises, and moves up and down in response to the rise and fall of the flush water level. When the flush water level rises, the flush water level on the outside of the drain hole float 82 rises, with air stored in the cap-shaped float interior space 96, so that an upward buoyancy is produced by the air stored in the interior space 96. When the drain hole float 82 is subjected to an upward buoyancy, the top surface 100 of the drain hole float 82 contacts the seal portion 102, and the flow path is sealed, blocking communication of the second tubular internal flow path 92 located on the inside of the second cylindrical portion 80 and the outside of the drain hole float 82 with the first tubular internal flow path 90 on the interior of the first cylindrical portion 78.

The flat portion 94 forms a downward facing plane, and a seal portion 102 extending downward from the ring-shaped flat portion 94 is disposed on this ring-shaped flat portion 94. The buoyancy-induced pushing of the drain hole float 82 top surface 100 against the seal portion 102 results in blocking of the first tubular internal flow path 90 inside the drain portion 74 and of the second tubular internal flow path 92; i.e., the drain portion 74 is closed off.

The seal portion 102 is formed in a cylindrical shape; contact with the top surface 100 of the drain hole float 82 at the bottom edge thereof results in sealing of the drain hole on the inside.

With the seal portion 102 and the drain hole float 82 in a non-contacting state, the drain portion 74 forms a flow path connecting the interior of the float rise speed control tank 38 and the exterior of the float rise speed control tank 38. With the seal portion 102 and the drain hole float 82 in a contacting state, the drain portion 74 separates the first tubular internal flow path 90 from the second tubular internal flow path 92 and forms respectively independent holding areas.

The float rise speed control tank 38 drain portion 74 of the flush toilet 1 in the present embodiment comprises a first cylindrical portion 78 and a second cylindrical portion 80, but in a variant example it is also possible for the drain portion 74 to be formed by only a small diameter hole formed in the bottom portion 72 of the float rise speed control tank 38, with the drain hole float 82 omitted. This type of drain portion 74 drain hole is formed in a diameter range of 1 mm to 15 mm. Therefore until the flush water level in the flush water tank 26 rises and reaches the window 76, the volume of flush water flowing from the drain portion 74 drain hole into the float rise speed control tank 38 can be restrained to a relatively small amount.

In the present embodiment, the float rise speed control tank 38 window 76 is formed over essentially the entire circumference of the float rise speed control tank 38. The float rise speed control tank 38 window 76 is formed inside the vertical walls 70 above the float 58. The window 76 is formed over essentially the entire circumference of the four sides of the vertical walls 70; i.e., over the essentially the entirety thereof. A support portion 104 is formed on the vertical walls 70 between one of the windows 76 and another of the windows 76. Because the size of the support portion 104 is formed to be relatively small, and the size of the window 76 is formed to be relatively large within the entire circumference, the flow path cross section of flush water flowing into the float rise speed control tank 38 from each window 76 when the flush water level rise reaches the height of the window 76 as described below is formed to be relatively large, and the volume of flush water flowing into the float rise speed control tank 38 from each window 76 (water volume per unit time) can be made relatively large.

Note that if the support portion 104 is omitted and the vertical walls 70 on the lower portion of the float rise speed control tank 38 are directly affixed to the inside wall, etc. of the flush water tank device 24 without mediation by the support portion 104, the windows 76 can be formed over the entire circumference of the float rise speed control tank 38. Thus when the windows 76 are formed over 100% of the entire circumference of the vertical walls 70, the vertical walls 70 below the windows 76 are supported by the support portions, etc. connected to the inside walls, etc. of the flush water tank device 24.

The float rise speed control tank 38 windows 76 is formed at essentially the same height position over the entire circumference of the float rise speed control tank 38. The bottom edges 106 of the opening parts of each of the windows 76 formed on the vertical walls 70 are formed at essentially the same height position H1 over the entire circumference. Therefore as described below, when the flush water level reaches the height position H1 of the windows 76 as it rises, flush water starts to simultaneously flow in one burst into the float rise speed control tank 38 from the bottom edges 106 of each window 76; the volume of flush water flowing into the float rise speed control tank 38 can be made relatively great, the rise speed of the flush water level inside the float rise speed control tank 38 can be increased, and the force at which the flush water inside the float rise speed control tank 38 seeks to rise can be made stronger than the force at which it seeks to rise on the outside thereof.

Note that even if the bottom edge 106 of some of the windows 76 are formed at a different height position, the windows 76 also includes cases in which the bottom edge 106 of other windows 76 are formed at approximately the same height position H1.

The top edges 107 of the windows 76 in the float rise speed control tank 38 are formed above the full water level WL0. Hence the windows 76 are formed so that the full water level WL0 is positioned on the windows 76. When the flush water level in the flush water tank 26 is at the full water level WL0, the flush water level inside the float rise speed control tank 38 is also at full water level WL0.

The bottom edges 106 of each window 76 are disposed at positions below the height of the full water level WL0, and are disposed at a position H1 above the height position H2 of the flush water level in the float rise speed control tank 38 at which the float starts to rise due to buoyancy.

The windows 76 bottom edges 106 are formed at the height position H3 from the bottom portion 72 of the float rise speed control tank 38. The height position H3 is set, for example, within a range of 17 mm to 33 mm from the bottom portion 72. Flush water flowing in from the windows 76 falls from a predetermined height H3 and bounces with force at the bottom portion 72, such that the float 58 is swayed laterally or vertically, thereby releasing static frictional force so that the float 58 can be made to rise. If the float 58 can be shaken to release the static frictional force between the float 58 and the stem 56, the float 58 can be made to oppose this static frictional force between this float 58 and the stem 56 and rise (dynamic friction force is smaller than static frictional force), and the float 58 can more easily be made to smoothly rise.

The bottom edge total length L1, which is the total of the lengths I of the bottom edges 106 of each window 76 as described above, is formed to have a length of 100% to 80% of the full circumference L2 of the horizontal cross section of the float rise speed control tank 38.

The float rise speed control tank 38 is formed so that when the flush water level inside the flush water tank 26 rises due to the supplying of flush water into the flush water tank 26 by the water supply device 28, and the flush water level reaches the windows 76, the inflow of flush water in the flush water tank 26 to the float rise speed control tank 38 from the windows 76 formed on the side above the float 58 bottom edge part 59 results in a flush water level rise speed (water surface rise speed) in the float rise speed control tank 38 which is faster than the flush water level rise speed (water surface rise speed) in the flush water tank 26.

For example, the flush water level rise speed in the float rise speed control tank 38 is set to a range from 7 mm/s to 100 mm/s from the start of inflow of flush water from the windows 76 until the flush water level reaches the height of the windows 76. Also, the flush water level rise speed in the float rise speed control tank 38 is set to a range from 7 mm/s to 100 mm/s, at least at the point when flush water reaches the height of the float 58.

The flush water level rise speed in the float rise speed control tank 38 is a relatively fast rise speed, therefore the float 58 is subjected to an increased buoyancy together with the relatively fast level rise of the float 58.

The internal flush water level rise speed of the float rise speed control tank 38 can be changed by changing the surface area of its internal horizontal cross section. The float rise speed control tank 38 is able to control the rise speed of the flush water level inside the float rise speed control tank 38 to a desired rise speed relative to the amount of flush water supplied per unit time by the water supply device 28.

For example, the surface area of the horizontal cross section at the height of the water storable area S1 inside the float rise speed control tank 38 is set to a range of 1/30 to 1/3 the surface area of the horizontal cross section at the same height position in the water storable area S2 inside the flush water tank 26. Also, the surface area of the horizontal cross section of the flush water tank 26 in the present embodiment is set to a range, for example, of 30000 $mm^2$ to 50000 $mm^2$, and preferably to a range of 40000 $mm^2$ to 50000 $mm^2$.

Figure 4:
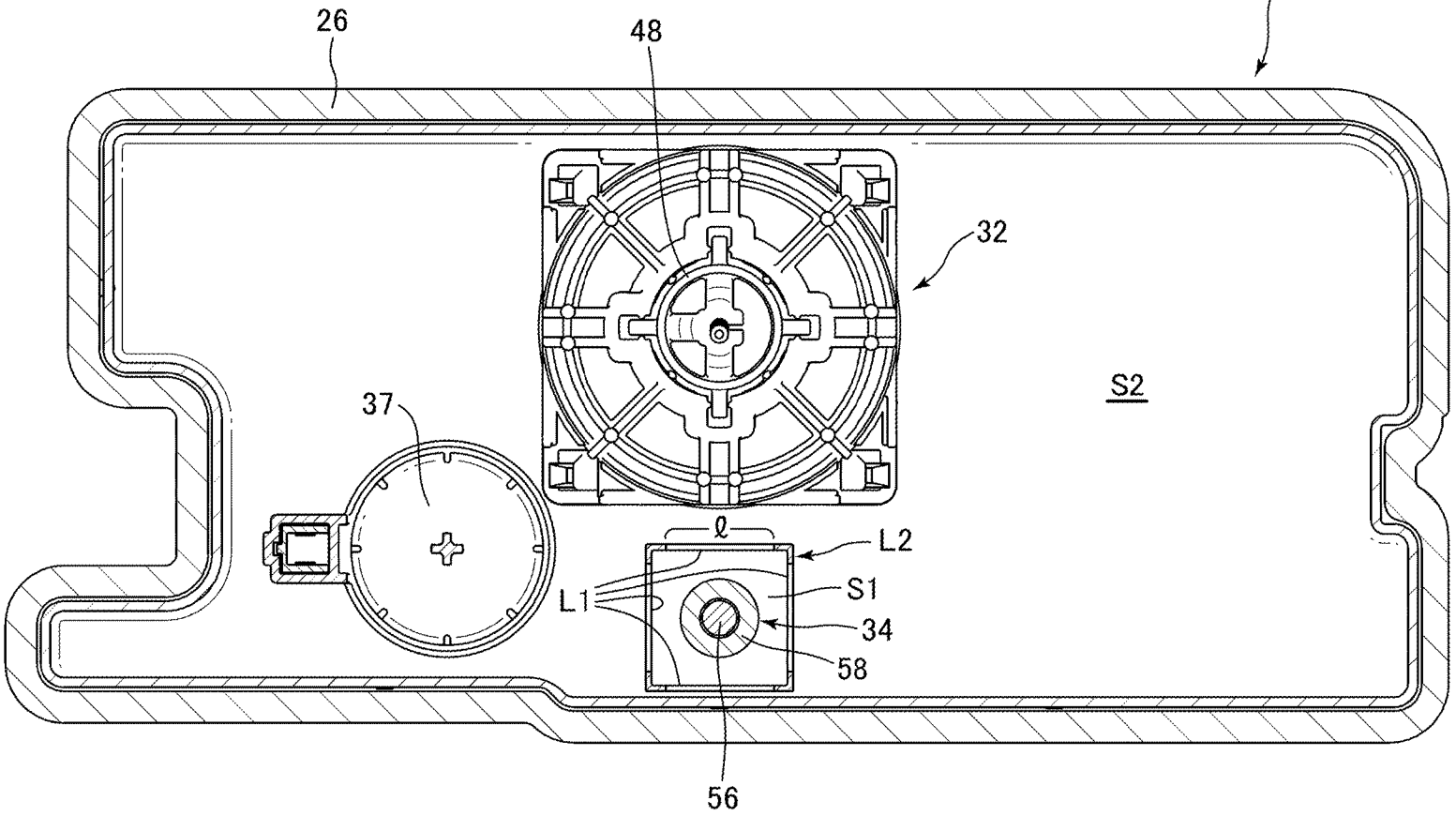
FIG. 4 is a cross sectional diagram viewed along line IV-IV in FIG. 3.

Next, referring to FIGS. 3, 4, and 7, the flushing operation (action) of a flush toilet according to a first embodiment of the invention is explained.

Note that of the two flush modes executed by a flush toilet according to a first embodiment of the invention, i.e., the large flush mode and the small flush mode, the basic operations of the large flush mode and the small flush mode are the same, except for fact that the amount by which the discharge valve device 32 discharge valve 54 is pulled up by the bead chain 52 is greater in the large flush mode than in the small flush mode, resulting in a longer flush water tank device 24 discharge port 30 release time, and that the dead water level (not shown) in the large flush mode is lower than in the small flush mode, therefore only the large flush mode is explained.

As shown in FIG. 3, in the standby state prior to start of discharge by the discharge valve device 32 (prior to flush start), the discharge valve device 32 discharge valve 54 is closing off the discharge port 30, and the initial water level inside the flush water tank device 24 is at full water level WL0. The float 58 is in a raised state, and the reed switch 66 is ON, while the water supply device 28 water supply valve 44 is in a closed state.

At this point, the drain hole float 82 is subjected to upward buoyancy by the air stored in the interior space 96; the top surface 100 of the drain hole float 82 contacts the seal portion 102, and the flow path is in a sealed state, blocking communication between the second tubular internal flow path 92 and the first tubular internal flow path 90. Therefore with the flow path in a blocked state, the storage area inside the float rise speed control tank 38 and the storage area inside the flush water tank 26 form respectively independent storage areas.

Next, a flush operation is started by user operation of the operating portion (not shown) or by predetermined judgements by the control device 36; the discharge valve device 32 releases the flush water tank device 24 discharge port 30, discharge in the large flush mode to the flush toilet 1 toilet main body 2 by the flush water tank device 24 discharge valve device 32 is started, and the water level inside the flush water tank 26 starts to descend.

Flush water is discharged from the flush water tank 26 discharge port 30 to the conduit 9 of the toilet main body 2 and the water level inside the flush water tank 26 drops; at the same time the control device 36, having received a start toilet flush request instruction, opens the water supply device 28 water supply valve 44 to start spouting a certain instantaneous flow volume into the flush water tank 26 from the spout port 46.

The drain hole float 82 descends when the water level inside the flush water tank 26 drops to below the height of the drain hole float 82. When this happens, contact between the drain hole float 82 top surface 100 and the seal portion 102 is released, the first tubular internal flow path 90 and the second tubular internal flow path 92 communicate, and flush water inside the float rise speed control tank 38 starts to flow from the drain portion 74 into the flush water tank 26. Thereafter, flush water inside the float rise speed control tank 38 flows from the drain portion 74 into the flush water tank 26, and the water level inside the float rise speed control tank 38 gradually drops. At this point, the flush water inside the float rise speed control tank 38 is at a higher position than the water level inside the flush water tank 26.

When the flush water level inside the float rise speed control tank 38 gradually drops, the height of the float 58 gradually drops along with the water level. When the height of the float 58 drops, the magnet 68 position also drops, therefore the reed switch 66 goes to an OFF state.

Next, when the water level inside the flush water tank 26 drops to the dead water level (not shown), the discharge valve device 32 closes the flush water tank 26 discharge port 30. Discharge into the flush toilet 1 toilet main body 2 by the discharge valve device 32 in the large flush mode is thus completed. During this interval, the float 58 is in a dropped state and the float switch 34 reed switch 66 is in an OFF state, so the water supply valve 44 is released, supply of water to the flush water tank 26 by the water supply device 28 is continued, and the water level inside the flush water tank 26 rises from the dead water level (not shown). Because water supplied to the flush water tank 26 by the water supply device 28 is a fixed supply water flow volume (fixed instantaneous flow volume), the flush water level inside the flush water tank 26 rises at essentially a first speed. The water level rise speed is obtained by dividing the flow volume of water supplied from the spout port 46 by the cross sectional area of the horizontal cross section of the flush water tank 26.

In addition, when supply of water from the water supply device 28 is continued and the water level rises, the drain hole float 82 also rises. An upward buoyancy acts on the drain hole float 82 due to air stored in the drain hole float 82 interior space 96, and contact between the drain hole float 82 top surface 100 and the seal portion 102 results in blockage of communication between the second tubular internal flow path 92 and the first tubular internal flow path 90.

As a result, even if the flush water level in the flush water tank 26 has risen up to the outer circumference of the lower portion of the float rise speed control tank 38, an empty state is maintained whereby flush water is not stored inside the float rise speed control tank 38. I.e., the interior of the float rise speed control tank 38 forms an empty internal space in which no flush water is stored, and since no flush water is present, the float 58 is in the most descended position.

When the flush water level inside the flush water tank 26 rises and reaches the bottom edge 106 of the windows 76, flush water in the flush water tank 26 flows from the windows 76 formed over essentially the entire circumference of the float rise speed control tank 38 into the float rise speed control tank 38 interior at essentially the same timing. Since a certain supply flow volume supplied from the water supply device 28 flows all at once from the windows 76 formed over essentially the entire circumference of the float rise speed control tank 38 into the float rise speed control tank 38, the rise speed of the flush water level inside the float rise speed control tank 38 becomes larger than the rise speed of the flush water level in the flush water tank 26. At this point the surface area of the horizontal cross section of the water storable area S1 inside the float rise speed control tank 38 is set to a range of 1/30 to 1/3, and preferably a range of 1/25 to 1/20, therefore even if the same fixed flow volume of supply water flows into the float rise speed control tank 38, the rise speed of flush water inside the float rise speed control tank 38 becomes faster than the outside rise speed. The rise speed of the flush water level inside the float rise speed control tank 38 is set to a range of 3 to 23 times the rise speed of the flush water level inside the flush water tank 26, and preferably to a range of 15 to 23 times thereof.

The flush water level rise speed in the float rise speed control tank 38 is a relatively fast rise speed, therefore the float 58 is subjected to an increased buoyancy and to lifting energy in the rising direction matching the relatively fast level rise of the float 58. Therefore even if the float switch 34 float 58 is subjected to forces acting to impede its movement (or such forces occur), such as static frictional force relative to the stem 56, or adhesion of air bubbles, the float 58 is subjected to an increased buoyancy and lifting energy or the like capable of overcoming the forces acting to impede movement between the float 58 and the stem 56, so that it rises without a time lag in response to a rise in the water level relative to the stem 56.

When the flush water level reaches the windows 76 during supply of water, flush water drops from the windows 76 formed above the bottom edge part of the float 58 into the empty float rise speed control tank 38. At this point, flush water dropping into the float rise speed control tank 38 splashes back inside the float rise speed control tank 38, further causing turbulence and creating waves in the water surface, causing the float 58 to sway up and down as well as front to back and left to right, so the float 58 is subjected to a force sufficient to overcome the forces acting to impede its movement, such as static frictional force between this float 58 and the stem 56, and the static frictional force between the float 58 and the stem 56 is released, thereby smoothly raising the float 58 relative to the stem 56.

After the float 58 has started to rise, in association with the rise of the flush water level inside the float rise speed control tank 38, the float 58 continues to be subjected to forces (e.g., buoyancy) capable of overcoming the forces acting to impede its movement, such as static frictional force between the float 58 and the stem 56, and the float 58 is made to rise smoothly relative to stem 56. When the water level in the flush water tank 26 reaches water level WL0 and the float 58 rises to a height position matching the full water level WL0, the position of the magnet 68 is also moved up along with the upward movement of the float 58, and the reed switch 66 changes from the OFF state to the ON state. The float switch 34 reed switch 66 issues a stop water supply signal to the control device 36, and the control device 36 having received this closes the water supply valve 44 so that water to the spout port 46 is stopped. The flush water level in the flush water tank 26 is thus maintained at a predetermined full water level WL0.

When the flush water level in the flush water tank 26 reaches the full water level WL0 and the water supply valve 44 is closed, the series of flush water tank device 24 flush operations is completed, and the device returns to a standby state.

In the flush toilet 1 according to the above-described first embodiment of invention, the float rise speed control tank 38 is formed so that during water supplying when the flush water level in the flush water tank 26 rises and reaches the windows 76, the flush water in the flush water tank 26 flows from the windows 76 formed above the float 58 bottom edge part 59 into the float rise speed control tank 38. The rise speed of the flush water level inside the float rise speed control tank 38 is increased more than the rise speed of the flush water level inside the flush tank 26. The float 58 is therefore subjected to a buoyancy force, which is increased in response to the increased water level rise speed. Therefore even if the float switch 34 float 58 is subjected to forces acting to impede its movement, such as the occurrence of static frictional force relative to the stem 56 or adherence of bubbles, buoyancy acting on the float 58 is increased to the point that it overcomes the force acting to impede movement between the float 58 and the stem 56, thus making it easier for the float 58 to rise relative to the stem 56. It is thus possible to prevent a situation in which movement of the float 58 on the stem 56 is impeded even though the flush water level is rising, such that the float switch 34 cannot operate at the proper timing, delaying the timing at which the water supply is stopped.

When the flush water level reaches the windows 76 during supply of water, flush water drops into the float rise speed control tank 38 from the windows 76 formed over the float 58, thereby creating turbulence on the water surface and swaying the float 58 so that the float 58 is subjected to a force capable of overcoming the static frictional force between the float 58 and the stem 56, thereby facilitating release of the static frictional force between the float 58 and the stem 56 so that the float 58 can more easily rise relative to the stem 56. It is thus possible to prevent a situation in which movement of the float 58 on the stem 56 is impeded even though the flush water level is rising, such that the float switch 34 cannot operate at the proper timing, delaying the timing at which the water supply is stopped.

Hence the float switch 34 can be reliably activated, and the supply of water reliably stopped.

Moreover, by using the flush toilet 1 according to the present embodiment, when the flush water level in the flush water tank 26 rises and reaches the windows 76, the flush water in the flush water tank 26 starts to flow all at once at essentially the same timing from the windows 76 formed at essentially the same height position as the float rise speed control tank 38, into the float rise speed control tank 38. Hence the rise speed of the flush water level inside the float rise speed control tank 38 is increased more than the rise speed of the flush water level inside the flush tank 26.

Therefore the float 58 can receive a more increased buoyancy force in response to the further increased water level rise speed.

Also, by using the flush toilet 1 according to the present embodiment, when the flush water level in the flush water tank 26 rises and reaches the windows 76, the flush water in the flush water tank 26 flows all at once from the windows 76 formed over essentially the entire circumference of the float rise speed control tank 38, into the float rise speed control tank 38. Hence the rise speed of the flush water level inside the float rise speed control tank 38 is increased more than the rise speed of the flush water level inside the flush tank 26. Therefore the float 58 can receive a more increased buoyancy force in response to the further increased water level rise speed.

Using the flush toilet 1 according the present embodiment, the drain hole float 82 stops the drain portion 74 using the buoyancy to which it is subjected by the rise in the flush water level, therefore until the flush water level in the flush water tank 26 rises and reaches the windows 76, flush water can be prevented from flowing from the drain portion 74 into the float rise speed control tank 38. Flush water can thus be made to flow all at once from the windows 76 into an empty float rise speed control tank 38, and the speed at which the flush water level in the float rise speed control tank 38 rises can be made to increase faster than the speed at which the flush water level in the flush water tank 26, and the float 58 can be subjected to an increased buoyancy in response to the increased level rising speed.

When the flush water level reaches the windows 76 during supply of water, flush water drops into an empty float rise speed control tank 38 from the windows 76 formed over the bottom edge part 59 of the float 58, thereby creating turbulence on the water surface and swaying the float 58 so that the float 58 is subjected to a force capable of overcoming the static frictional force between the float 58 and the stem 56, thereby facilitating release of the static frictional force between the float 58 and the stem 56 so that the float 58 can more easily rise relative to the stem 56.

Using the flush toilet 1 according to the present embodiment, the rise speed of the flush water level in the float rise speed control tank 38 is set in a range of the 7 mm/s to 100 mm/s. Therefore the float can be acted upon by a further increased buoyancy corresponding to a water level rise speed of 7 mm/s to 100 mm/s.

Using the flush toilet 1 according to the present embodiment, the drain portion 74 is formed by a drain hole sized in a diameter range of 1 mm to 15 mm, as the flush water level is dropping with the discharge of flush water in the flush water tank 26, all or substantially all of the flush water in the float rise speed control tank 38 flows out of the drain hole in the drain portion 74, and when water is being supplied to the flush water tank 26 until the flush water level around the float rise speed control tank 38 reaches the windows 76, the amount of flush water flowing into the float rise speed control tank 38 from the drain portion 74 drain hole is kept down to a relatively small volume at a position lower than the bottom edge part 59 of the float 58. Therefore flush water can be made to flow all at once from the windows 76 into a float rise speed control tank 38 with a relatively low water level, and the speed at which the flush water level in the float rise speed control tank 38 rises can be made to increase faster than the speed at which the flush water level in the flush water tank 26, and the float 58 can be subjected to an increased buoyancy in response to the increased level rising speed.

When the flush water level reaches the windows 76 during supply of water, flush water drops into a relatively low water level float rise speed control tank 38 from the windows 76 formed over the bottom edge part 59 of the float 58, thereby creating turbulence on the water surface and swaying the float 58 so that the float 58 is subjected to a force capable of overcoming the static frictional force between this float 58 and the stem 56, thereby facilitating release of the static frictional force between the float 58 and the stem 56 so that the float 58 can more easily rise relative to the stem 56.

Next, referring to FIGS. 8 through 15, a flush toilet 101 according to a second embodiment of the invention is explained. In the flush toilet of the present embodiment, the float rise speed control tank 138 differs from the above-described float rise speed control tank 38 of the first embodiment. Here points of difference between the second embodiment and the first embodiment of the invention are mainly explained; the same reference numerals are given to similar parts, and an explanation thereof is here omitted.

Figure 8:
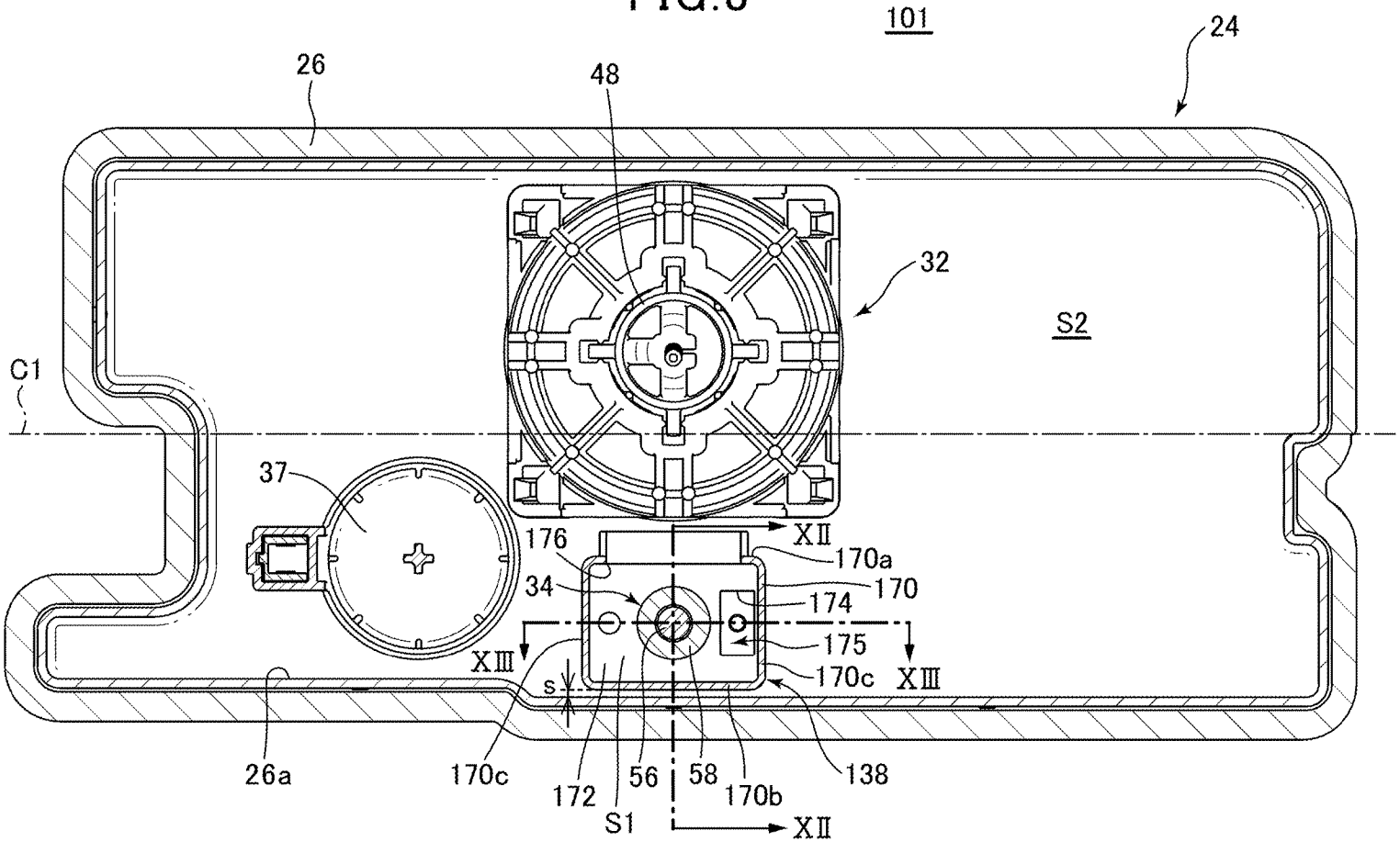
FIG. 8 is a cross sectional diagram seen along a horizontal cross section at the height position of the float rise speed control tank of a flush water tank device in a flush toilet according to a second embodiment of the invention.
Figure 9:
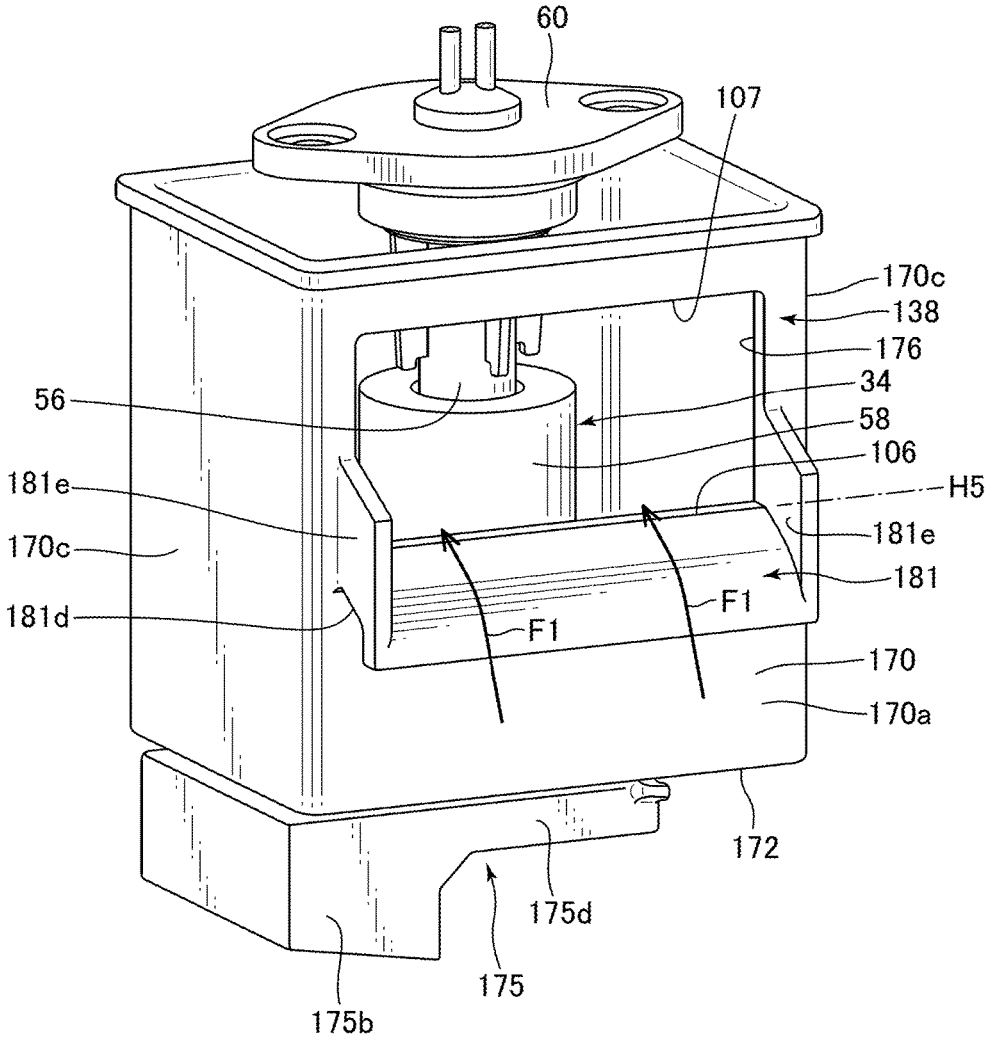
FIG. 9 is a perspective view seen from diagonally above of a float rise speed control tank in a flush toilet according to a second embodiment or the invention.
Figure 10:
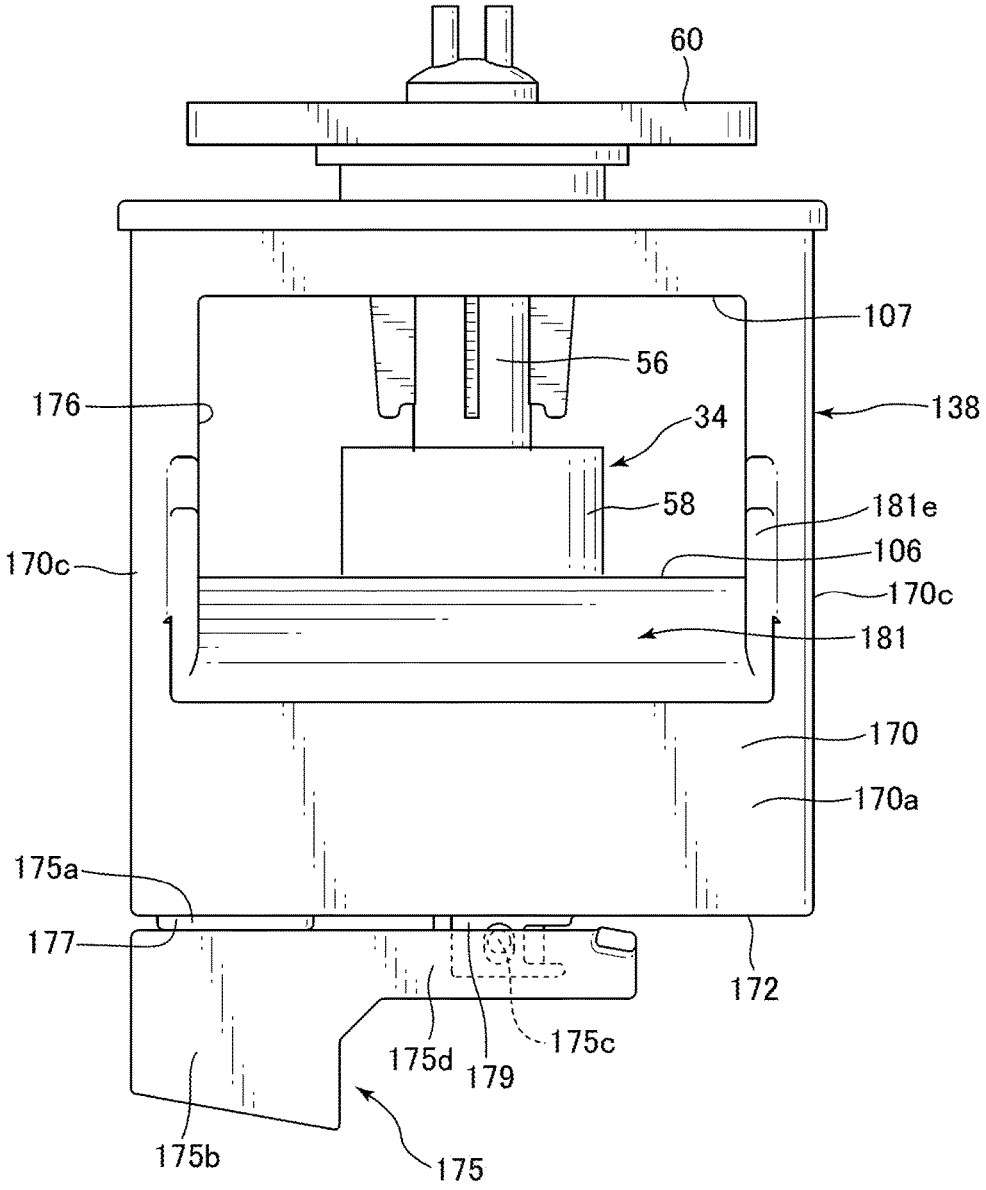
FIG. 10 is a front elevation seen close to the center of a flush water tank, in a closed position whereby the float rise speed control tank damper portion is closing off the drain hole, in a flush toilet according to a second embodiment of the invention.
Figure 11:
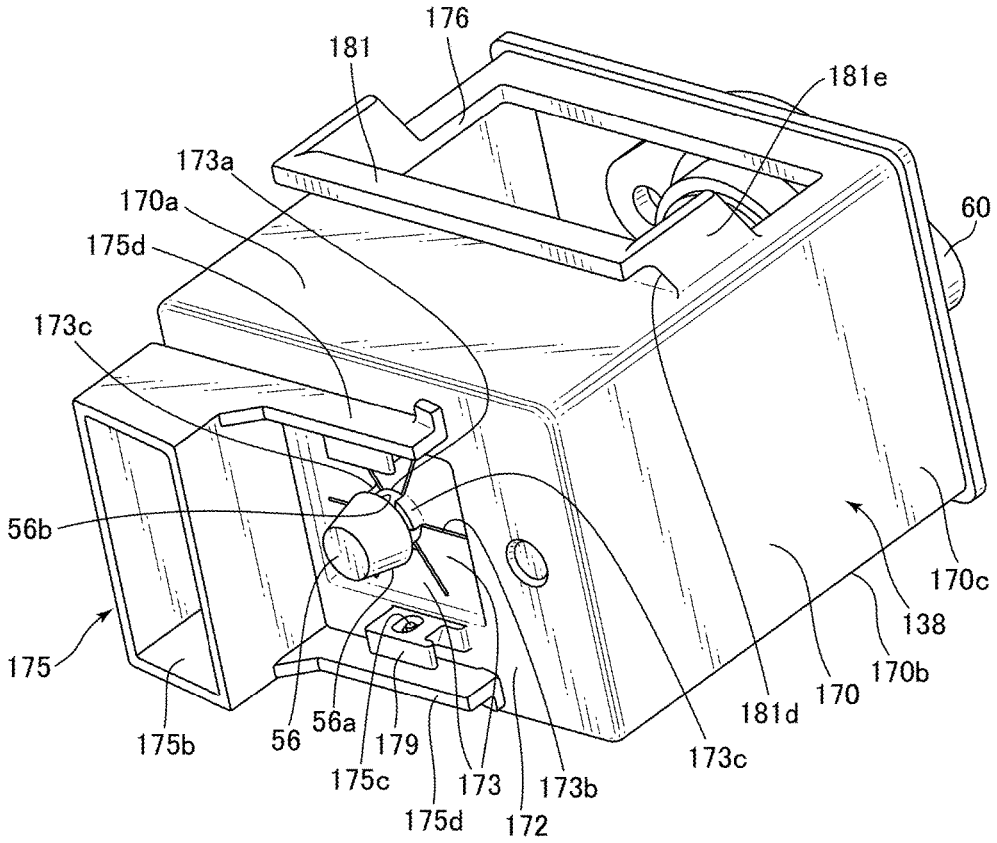
FIG. 11 is a perspective view seen from diagonally below a float rise speed control tank in a flush toilet according to a second embodiment or the invention.
Figure 12:
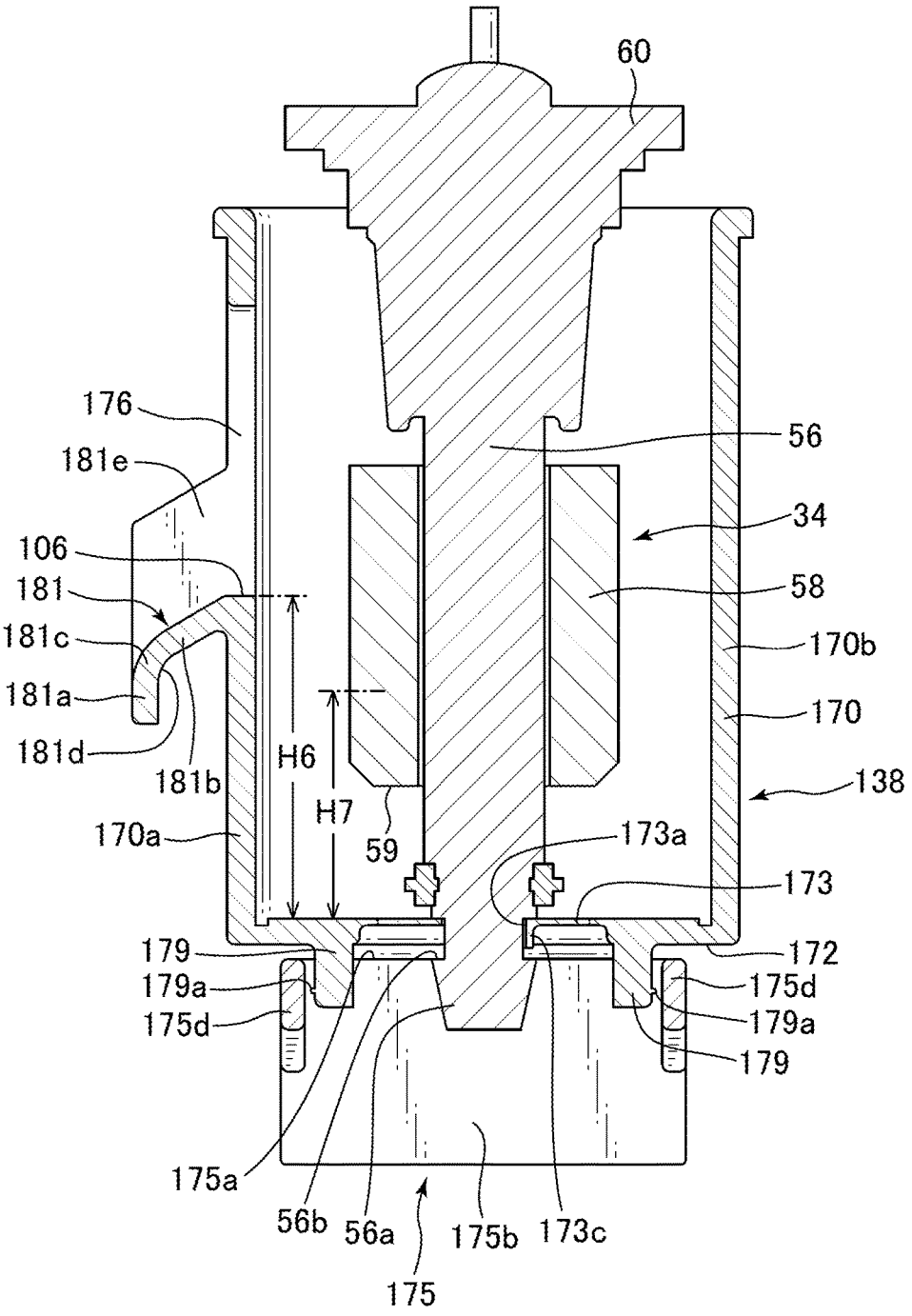
FIG. 12 is a cross sectional diagram viewed along line XII-XII in FIG. 8.
Figure 13:
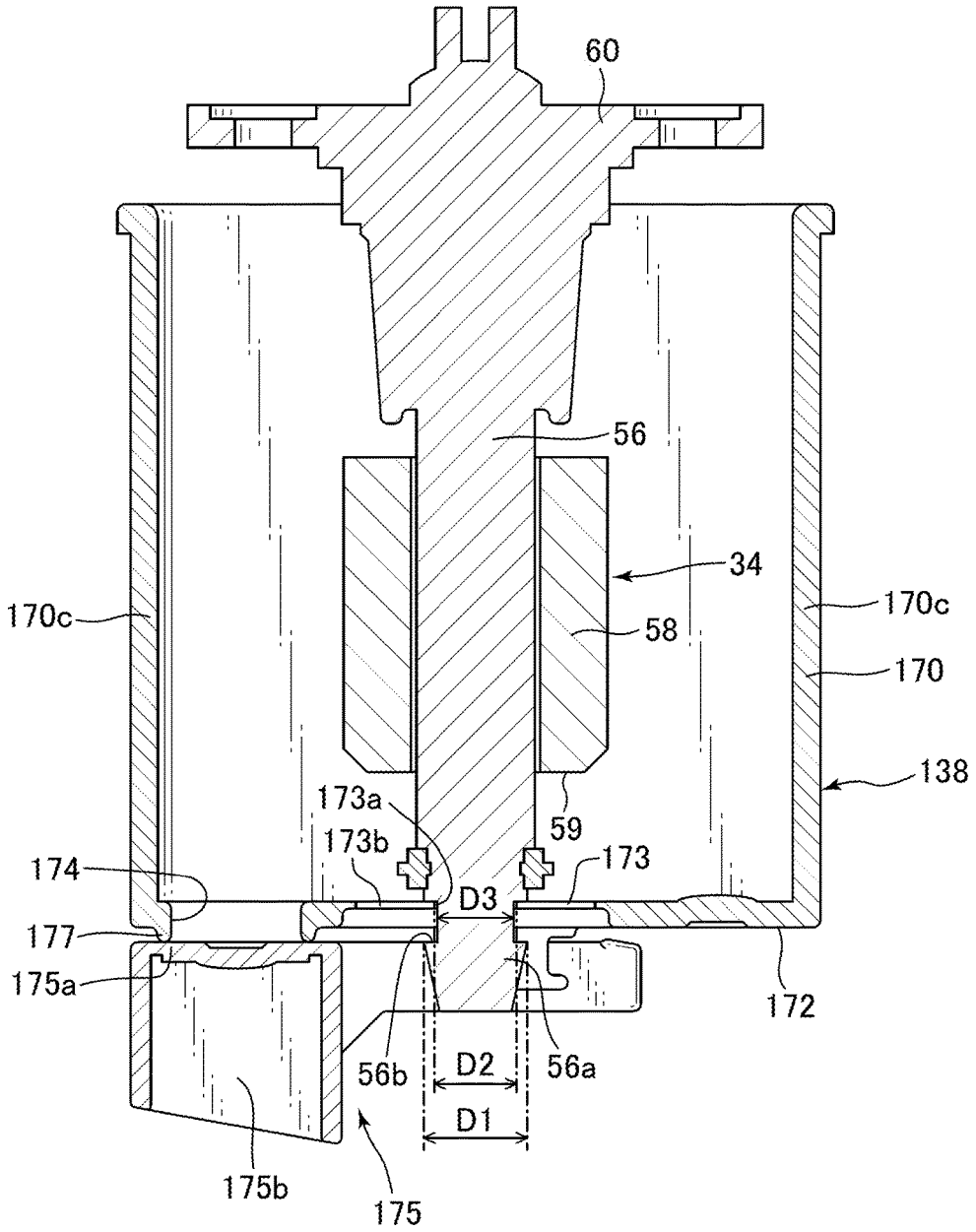
FIG. 13 is a cross sectional diagram viewed along line XIII-XIII in FIG. 8.
Figure 14:
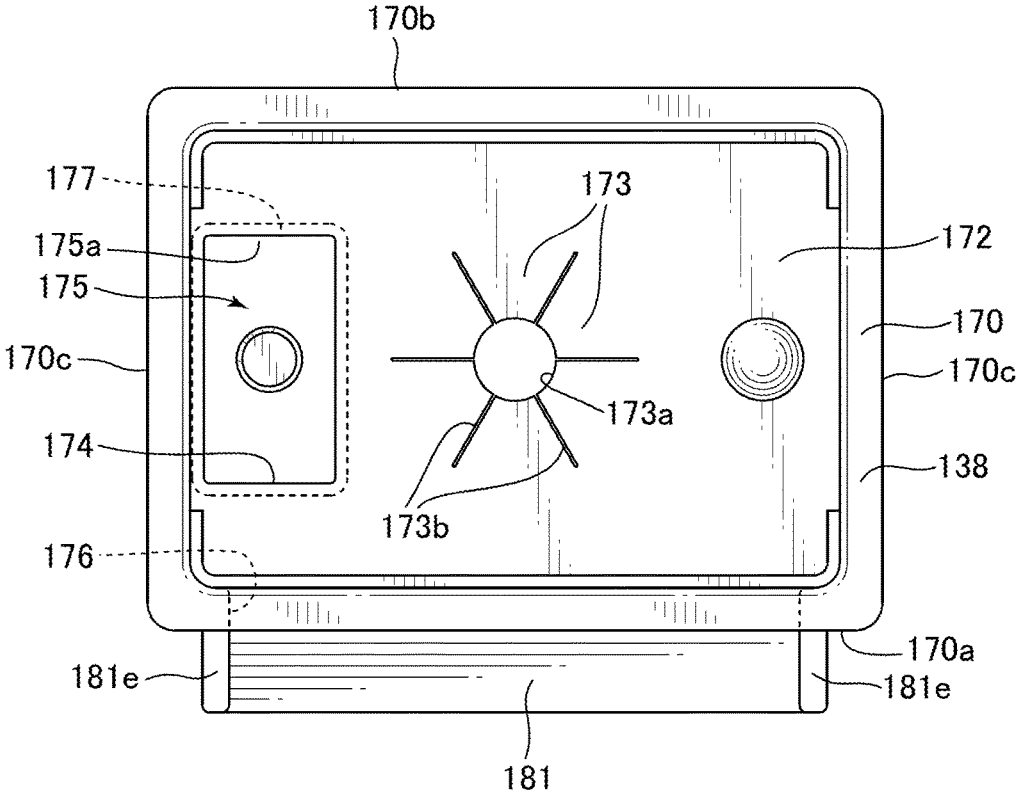
FIG. 14 is a top plan view seen from above of a float rise speed control tank on a flush toilet according to a second embodiment of the invention, with the float switch removed.
Figure 15:
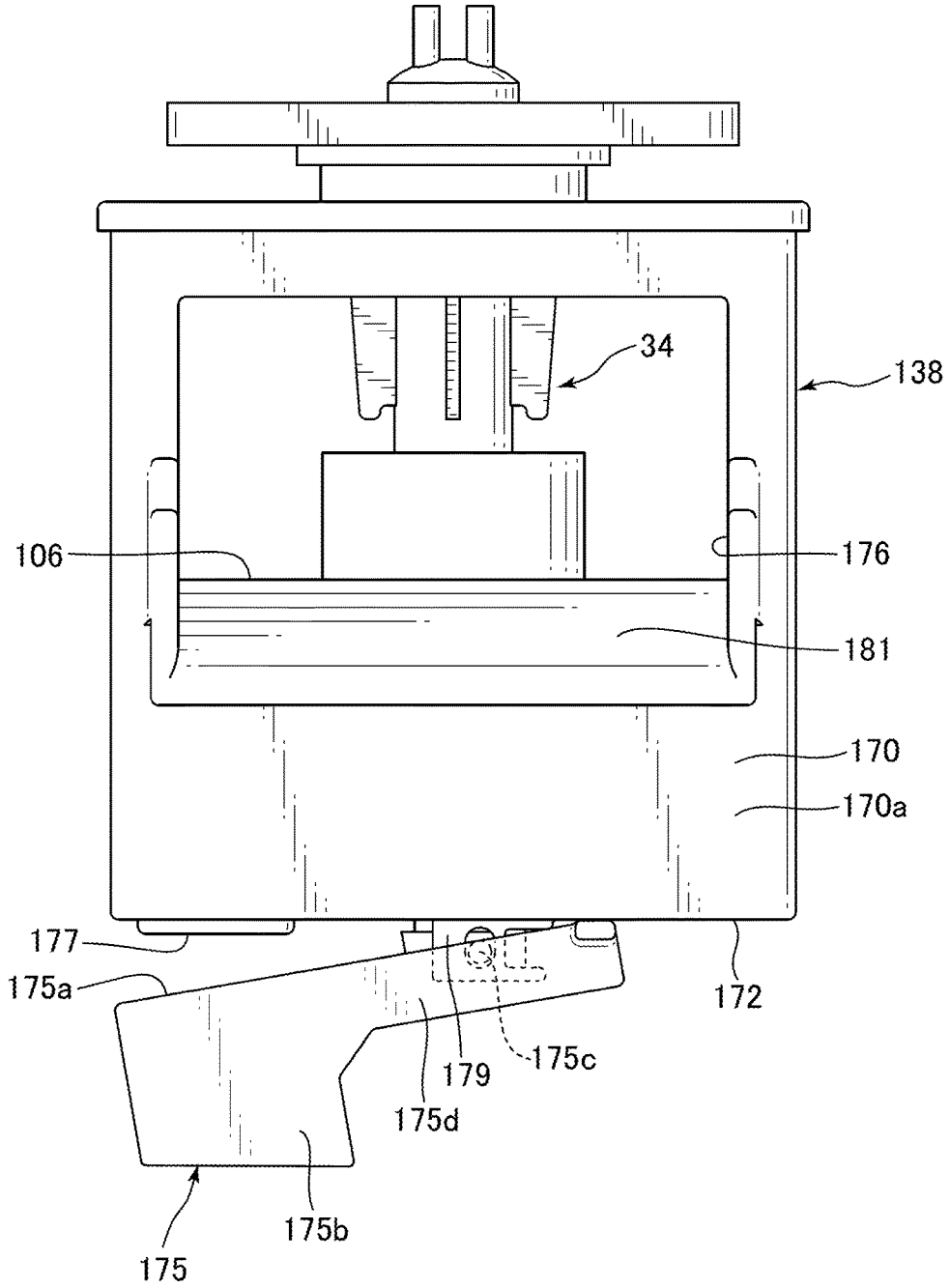
FIG. 15 is a front elevation seen close to the center of a flush water tank, in a released position whereby the float rise speed control tank damper portion releases the drain hole to a relatively large extent, in a flush toilet according to a second embodiment of the invention.

FIG. 8 is a cross sectional diagram seen along a horizontal cross section at the height position of the float rise speed control tank of a flush water tank device in a flush toilet according to a second embodiment of the invention; FIG. 9 is a perspective view seen from diagonally above of a float rise speed control tank in a flush toilet according to a second embodiment or the invention; FIG. 10 is a front elevation seen close to the center of a flush water tank, in a closed position whereby the float rise speed control tank damper portion is closing off the drain hole, in a flush toilet according to a second embodiment of the invention; FIG. 11 is a perspective view seen from diagonally below a float rise speed control tank in a flush toilet according to a second embodiment or the invention; FIG. 12 is a cross sectional diagram viewed along line XII-XII in FIG. 8; FIG. 13 is a cross sectional diagram viewed along line XIII-XIII in FIG. 8; FIG. 14 is a top plan view seen from above of a float rise speed control tank on a flush toilet according to a second embodiment of the invention, with the float switch removed. FIG. 15 is a front elevation seen close to the center of a flush water tank, in a released position whereby the float rise speed control tank damper portion releases the drain hole to a relatively large extent, in a flush toilet according to a second embodiment of the invention.

As shown in FIGS. 8 through 13, the flush toilet 101 and a float rise speed control tank 138 according to a second embodiment of the invention are explained in detail.

The float rise speed control tank 138 is formed to surround at least the bottom portion of the float 58 on the inside of the flush water tank device 24 and the outside of the float 58.

The float rise speed control tank 138 is formed in a right angle parallelepiped shape. Therefore the float rise speed control tank 138 is formed so that on the outside of the float 58 the sides of the right angle parallelepiped surround the perimeter of the upper and lower portions (including the bottom portion) of the float 58. The float rise speed control tank 138 may be formed not only as a right angle parallelepiped, but also in a cylindrical or other shape.

The float rise speed control tank 138 comprises vertical walls 170 formed on the outside of the float 58 and extending in the vertical direction; a bottom portion 172 extending inward from the bottom edge of the vertical walls 170 and formed to surround the lower portion (including the bottom portion) of the float 58; a drain portion 174 forming a drain hole for draining that bottom portion 172; and window 176 formed on the vertical walls 170 in one of the areas above the bottom edge part 59 of the float 58 and below the peak portion of the vertical walls 170.

The vertical walls 170 form the 4 flat wall surface sides of the right angle parallelepiped float rise speed control tank 138. The bottom portion 172 forms the bottom surface of the right angle parallelepiped float rise speed control tank 138, and is formed as an essentially flat surface. Even though the bottom portion 172 is formed as a flat surface, the damper-side seal portion 175*a*, described below, is able to release the drain portion 174 as a relatively large opening, therefore a relatively strong flow of flush water flowing out from the drain portion 174 is formed, and small objects can be reliably discharged from the bottom portion 172 through the drain portion 174. Note that the bottom portion 172 may also be formed to have a downward slope toward the drain portion 174.

The vertical walls 170 comprise a center side wall 170*a* toward the center of the flush water tank 26, a side vertical wall 170*b* extending in a direction parallel to the flush water tank 26 inner side wall 26*a* and disposed at a position close to the flush water tank 26 inner side wall 26*a*, and side walls 170*c*, extending in a direction perpendicular to the flush water tank 26 inner side wall 26*a* and facing the sides of the flush water tank 26 in the left-right direction.

As shown in FIG. 8, the side vertical wall 170*b* extends approximately parallel to the flush water tank 26 inner side wall 26*a*. A gap s is formed between the side vertical wall 170*b* of the vertical walls 170 and the inner side wall 26*a* of the flush water tank 26. In the present embodiment, the flush water tank 26 inner side wall 26*a* is the front-side inner side wall 26*a* of the flush water tank 26, but the flush water tank 26 inner side wall 26*a* may also be an inside wall on the rear side or the lateral sides of the flush water tank 26. I.e., the float rise speed control tank 138 can be disposed toward any of the inside walls, including the front side, the rear side, or the lateral sides within the flush water tank 26. In any of these placement methods, the window 176 is formed on a center side wall 170*a* toward the center side of the flush water tank 26. In addition, the window 176 is formed only on the center side wall 170*a* and not on the side vertical wall 170*b* or the side walls 170*c* so as to impede the inflow of small objects positioned close to the inner side wall 26*a*.

The center side wall 170*a* is disposed closed to the center side among the vertical walls 170. The center side wall 170*a* is formed on the wall opposite the inner side wall 26*a* of the flush water tank 26. Relative to the side vertical wall 170*b*, which is disposed at a position on the near side close to the flush water tank 26 inner side wall 26*a*, the center side wall 170*a* is disposed on the side far from the inner side wall 26*a*.

In a vertical cross section such as that shown in FIG. 8, the center side wall 170*a* does not form a wall surface which is continuous with the inner side wall 26*a* of the flush water tank 26, therefore on the water surface, small objects attracted by surface tension to the inner side wall 26*a* of the flush water tank 26, for example floating objects or foreign objects such as debris, etc., do not move by passing along a continuous wall surface from the flush water tank 26 inner side wall 26*a* to the center side wall 170*a*. Thus the float rise speed control tank 138 is formed so that floating objects floating in the flush water tank 26 have difficulty flowing into the window 176 in the center side wall 170*a* from the inner side wall 26*a* of the flush water tank 26.

The bottom portion 172 forms an essentially flat square-shaped bottom surface. A stem attaching portion 173 (attachment opening portion) attached to the end portion 56*a* of the stem 56 on the float switch 34 is formed at approximately the center of the bottom portion 172.

The body detecting sensor 173 forms a circular opening portion 173*a* with a diameter D2 slightly smaller than the diameter D1 of the stem 56 end portion 56*a*. Also, the stem attaching portion 173 forms a circular opening portion 173*a* having a diameter D2 slightly larger than the diameter D3 of the stem 56 at the height position corresponding to the height position of the stem attaching portion 173.

The stem attaching portion 173 forms a cut-in portion 173*b* extending radially from this circular opening portion 173*a*. Therefore the stem 56 end portion 56*a*, which has a diameter D1 farther than the diameter D2 of the stem attaching portion 173, can be inserted through the circular opening portion 173*a*, and after the end portion 56*a* of the stem 56 is inserted through the circular opening portion 173*a*, the stem 56 end portion 56*a* can be rendered difficult to pull out from the circular opening portion 173*a*. Thus the float rise speed control tank 138 can be supported by the float switch 34 with the stem 56 end portion 56*a* inserted through the circular opening portion 173*a*, so that the float rise speed control tank 138 is attached to the float switch 34 stem 56.

In addition, the stem attaching portion 173 forms return portions 173*c* (tilt suppression portions) disposed at equal spacing at three locations on the outer circumference of the circular opening portion 173*a*. These return portions 173*c* form projections which project from the bottom surface of the float rise speed control tank 138 bottom portion 172 toward the bottom side in the vertical direction. The return portions 173*c* form an arc shape along the inside circumference of the circular opening portion 173*a*. The tip edges of the return portions 173*c* (the bottom edge surfaces of the return portions 173*c* when the float rise speed control tank 138 is in an attached state) are formed as planes.

The size of the three return portions 173*c* and the lengths (heights) and lateral widths of the projections are all identically formed, and each is disposed at equal spacing on the circumference. Therefore with the stem 56 end portion 56*a* inserted through the circular opening portion 173*a*, the stem 56 end portion 56*a* edge portion 56*b* and the return portions 173*c* are in contact, and are disposed so that the return portions 173*c*, which is to say the float rise speed control tank 138, sit on the edge portion 56*b* of the stem 56 end portion 56*a*. Because the three return portions 173*c* are disposed symmetrically relative to the center of the circular opening portion 173*a* (e.g., so that the angles between the three return portions 173*c* are respectively 120°), the return portions 173*c* sitting on the edge portion 56*b* of the stem 56 end portion 56*a* are relatively stable, and tilting and slippage of the float rise speed control tank 138 can be restrained, not only in the up and down direction, but also in the front to back and left-right directions (circumferential direction). Tilt of the float rise speed control tank 138 relative to the stem 56 can be held appropriate horizontal, therefore tilting of the flush water level inside the float rise speed control tank 138 relative to the float can be restrained, and timing of the float switch 34 operation can be precisely maintained.

Also, the placement and/or number of the return portions 173*c* can be changed. The return portions 173*c* may, for example, also be disposed at six equally spaced locations on the inside circumference of the circular opening portion 173*a*. It is also possible to form the return portions 173*c* at two or four locations so that the float rise speed control tank 138 can be stably disposed on the edge portion 56*b* of the stem 56 end portion 56*a*.

Alignment of the stem 56 end portion 56*a* with the return portions 173*c* results in the stable combination of the float switch 34 and the float rise speed control tank 138, so that the float switch 34 stem 56 end portion 56*a* can be affixed close to the bottom portion 172 of the float rise speed control tank 138, and the float switch 34 and float rise speed control tank 138 can be reliably affixed and disposed with a stable orientation, so that the float switch 34 can be correctly operated.

The drain portion 174 of the float rise speed control tank 138 is formed as an opening portion communicating between the inside and the outside of the float rise speed control tank 138 at the bottom portion 172 of the float rise speed control tank 138. The drain portion 174 forms a relatively large opening portion formed in a square shape. This relatively large opening portion is formed at a size capable of discharging floating objects (small objects) such as foreign objects, waste, and the like flowing into the float rise speed control tank 138.

The drain portion 174 of the float rise speed control tank 138 comprises a drain-side seal portion (drain hole valve body portion) 177 on the downstream end of the drain portion 174. The drain-side seal portion 177 is formed on the inside circumference of the drain portion 174 square opening portion, and is formed to project slightly downward from the bottom portion 172 of the float rise speed control tank 138. The drain-side seal portion 177 forms a seal part slightly larger than the opening portion of the drain portion 174. The drain-side seal portion 177, by aligning with the damper-side seal portion 175*a*, described below, serves to seal the drain portion 174 in a watertight manner.

The drain portion 174 of the float rise speed control tank 138 comprises a damper portion 175 (opening and closing mechanism), which forms an opening and closing mechanism for opening and closing the drain portion 174. The damper portion 175 forms an opening and closing mechanism for opening and closing the drain portion 174.

The damper portion 175 comprises: a damper-side seal portion 175*a* (seal portion) for opening and closing the opening flow path inside the drain portion 174; a drain hole float 175*b*, connected to the damper-side seal portion 175*a* and formed so that by being subjected to buoyancy from the rising flush water level, it pushes the damper-side seal portion 175*a* onto the drain portion 174 drain-side seal portion 177, thereby closing off the flow path; a support arm 175*d* for permitting the damper-side seal portion 175*a* and the drain hole float 175*b* to rotate about a support point 175*c*; and a damper attaching portion 179 projecting downward from the bottom surface of the float rise speed control tank 138.

This damper portion 175 has a stopped orientation in which the drain portion 174 is closed off by the damper-side seal portion 175*a* and the drain-side seal portion 177, and an open orientation, in which the drain portion 174 is opened relatively widely by moving the damper-side seal portion 175*a* diagonally from this closed orientation.

The damper-side seal portion 175*a* forms a valve body placed on the top surface of the damper portion 175. The damper-side seal portion 175*a* is formed in a size and shape to fit the size of the drain-side seal portion 177 inside the drain portion 174, and in this embodiment forms an essentially square valve body. Because the damper-side seal portion 175*a* is formed at the peak portion of the drain hole float 175*b*, it rises or drops in tandem with the drain hole float 175*b*. Therefore the damper-side seal portion 175*a* is also subjected to the buoyancy received by the drain hole float 175*b*, and is pushed onto the drain portion 174 drain-side seal portion 177, sealing the drain portion 174. When the drain hole float 175*b* is not subjected to buoyancy, or the buoyancy is relatively small, the damper-side seal portion 175*a* separates from the drain portion 174, and the drain portion 174 is opened as a relatively large opening.

If the damper-side seal portion 175*a* and the drain-side seal portion 177 are not in contact, the drain portion 174 forms a flow path connecting the interior of the float rise speed control tank 138 to the exterior of the float rise speed control tank 138. If the damper-side seal portion 175*a* and the drain-side seal portion 177 are in contact, the interior of the float rise speed control tank 138 is separated from the exterior of the float rise speed control tank 138, and each forms an independent storage area.

The damper-side seal portion 175*a* is formed as an essentially flat plan on the top surface of the damper portion 175. When the drain hole float 175*b* has descended and the damper-side seal portion 175*a* separates from the drain-side seal portion 177 to release the drain portion 174, flush water in the float rise speed control tank 138 flows downward out of the drain portion 174, flows over the damper-side seal portion 175*a* on the top surface of the damper portion 175 and into the flush water tank 26. Flush water can thus flow over the damper-side seal portion 175*a* formed as an essentially flat surface, then flow out.

The drain hole float 175*b*, in a state of attachment to the bottom surface of the float rise speed control tank 138, forms a downward-opening box shape. When the water level in the flush water tank 26 rises, the drain hole float 175*b* enters a state whereby air is accumulated in the space within the drain hole float 175*b*, so that further rising of the flush water level produces an upward buoyancy caused by the accumulated air. The drain hole float 175*b*, by being subjected to upward buoyancy and rising (or by being subjected to an upward force in a stopped state), causes the damper-side seal portion 175*a* to be pressed onto the drain-side seal portion 177 of the drain portion 174. The state whereby the damper-side seal portion 175*a* is pressed against the drain-side seal portion 177 seals the flow path so that communication is blocked between the float rise speed control tank 138 internal space and the space inside the flush water tank 26 outside the float rise speed control tank 138, producing a state whereby the drain portion 174 is sealed in a watertight manner. At this point, the drain hole float 175*b* is rotated about the support point 175*c* to rise via the support arm 175*d*.

The support arm 175*d* is a rod-shaped member formed to connect the drain hole float 175*b* and damper-side seal portion 175*a* to the support point 175*c*. The support arm 175*d* is formed so that two arms extend parallelly from the two edges of the drain hole float 175*b*. The support arms 175*d* are constituted to be capable of rotating the drain hole float 175*b* and the damper-side seal portion 175*a* within a specified angle in the up-down direction, centered on the support point 175*c*.

The support point 175*c* disposed at the base portion of the support arm 175*d* is attached to the damper attaching portion 179 projecting downward from the bottom surface of the float rise speed control tank 138, and is capable of freely rotating relative to the damper attaching portion 179.

As shown in FIG. 12, the damper portion 175 further comprises a raised portion 179*ax* projecting toward the gap space between the support arm 175*d* and the damper attaching portion 179. The tip of the raised portion 179*ax* is rounded and approximately spherical. I.e., the raised portion 179*a* is formed as a very small semisphere. The raised portion 179*a* has the function of restraining (or limiting) contact between the support arm 175*d* and the damper attaching portion 179 to point contact. I.e., even when the support arm 175*d* and the damper attaching portion 179 do contact, the raised portion 179*a* has the function of limiting such contact to point contact without allowing surface contact over a relatively wide area. This "point contact" term is not limited to a pure single point, but also includes contact in a single point area part; i.e., it includes simultaneous contacts in areas of tiny breadth. The formation of this tiny raised portion 179*a* results in the maintaining at all times of a tiny gap between the support arm 175*d* and the damper attaching portion 179, so that the support arm 175*d* and the support arm 175*d* can be prevented from tightly adhering, and contact by the support arm 175*d* with damper attaching portion 179 can restrained, so that adhesion between the support arm 175*d* and the damper attaching portion 179 caused by various components in water, etc. can be prevented. Thus damper portion 175 operational failures caused by adhesion between the support arm 175*d* and the damper attaching portion 179 can be prevented from occurring.

In the present embodiment the window 176 of the float rise speed control tank 138 is formed on one of the center side wall 170*a* sides close to the center of the flush water tank 26 among the four sides of the box shaped vertical walls 170. In the float rise speed control tank 138, the window 176 is opened toward the inside of the flush water tank 26, for example toward the inside facing a flush water tank 26 cross section line Cl dividing the flush water tank 26 into two parts, being a front part and a back part in the front-back direction, and more preferably is opened toward the center area of the flush water tank 26. The window 176 forms a square, relatively large opening portion on one surface of the center side wall 170*a* closer to the center side of the flush water tank 26. No window 176 is formed in the side vertical wall 170*b* and the side walls 170*c* forming the three surfaces of the four surfaces forming the box shape. Therefore the float rise speed control tank 138 forms only the window 176, which opens toward the inside of the flush water tank 26.

The float rise speed control tank 138 center side wall 170*a* is a wall surface positioned furthers away from the inner side wall 26*a* of the flush water tank 26, so small objects prone to approach the inner side wall 26*a* can be impeded from flowing into the center side wall 170*a* window 176.

The vertical walls 170, which include the float rise speed control tank 138 center side wall 170*a* does not form a continuous wall surface with the flush water tank 26 inner side wall 26*a*, are therefore formed so that small objects, e.g. foreign objects such as floating waste, etc. attracted by surface tension to the flush water tank 26 inner side wall 26*a* do not move so as to transit across a continuous wall surface from the inner side wall 26*a* of the flush water tank 26 to the center side wall 170*a*.

The window 176 is placed on the center side wall 170*a* close to the center side of the flush water tank 26. Here the center side wall 170*a* is positioned relatively close to the water supply device 28 spout port 46 disposed in the center vicinity area of the flush water tank 26, and is also positioned in the midst of the flow so that flush water spouted from the spout port 46 spreads out from the center vicinity toward the inner side wall 26*a* of the flush water tank 26. Therefore small objects flowing into the flush water tank 26 are more easily flushed out toward the inner side wall 26*a* of the flush water tank 26, even further outside than the center side wall 170*a*.

Rather than collecting close to the center side wall 170*a*, small objects flowing into the flush water tank 26 are flushed out toward the inner side wall 26*a* of the flush water tank 26, still further out than the center side wall 170*a*, and are pulled in by surface tension on the inner side wall 26*a* of the flush water tank 26. Small objects thus have less tendency to collect close to the center side wall 170*a* positioned toward the center side of the flush water tank 26. Also, even if no small objects were contained in the flush water spouted from the spout port 46, when water is being supplied, while the water level in the flush water tank 26 is lower than the window 176, small objects are more easily flushed toward the inner side wall 26*a* of the flush water tank 26 further outside than the center side wall 170*a*, and less able to flow from the window 176 into the float rise speed control tank 138.

When used with a hand-washing device enabling users to wash their hands, attached on top of the flush water tank device 24, discharge from the hand-washing device is made to flow into the center vicinity of the flush water tank 26. When so doing, even if the discharge water from the hand-washing device does contain small objects, the inflowing small objects are easily flushed out toward the inner side wall 26*a* of the flush water tank 26, which is still further out than the center side wall 170*a*.

Because the size of this window 176 opening is formed to be relatively large, the flow path cross section of flush water flowing into the float rise speed control tank 138 from each window 176 when the flush water level rise reaches the height of the window 176 as described below is formed to be relatively large, and the volume of flush water flowing into the float rise speed control tank 138 from each window 176 (water volume per unit time) can be made relatively large.

The window 176 of the float rise speed control tank 138 is formed inside the vertical walls 170 on the top side the float 58. The window 176 forms an opening part of a relatively large size covering essentially the entirety of the center side wall 170*a* in the left-right direction. The bottom edge 106 of opening portion of the window 176 formed in the 170*a* is formed at a predetermined height H1. Therefore as described below, when the flush water level reaches the height position H5 of the window 176 as it rises, flush water starts to flow in one burst into the float rise speed control tank 138 from the bottom ends 106 of the window 176; the volume of flush water flowing into the float rise speed control tank 138 can be made relatively great, the rise speed of the flush water level inside the float rise speed control tank 138 can be increased, and the force at which the flush water inside the float rise speed control tank 138 seeks to rise can be made stronger than the force at which it seeks to rise on the outside thereof.

The top ends 107 of the window 176 of the float rise speed control tank 138 are formed above the full water level WL0. Hence the window 176 is formed so that the full water level WL0 is positioned on the window 176. When the flush water level in the flush water tank 26 is at the full water level WL0, the flush water level inside the float rise speed control tank 138 is also at full water level WL0.

The bottom ends 106 of the window 176 are disposed at positions below the height of the full water level WL0, and are disposed at a position H5 above the height position H2 of the flush water level in the float rise speed control tank 138 at which the float 58 starts to rise due to buoyancy. The float 58 is constituted so that the float is subjected to buoyancy and starts to rise at a flush water level height position H2 (see FIG. 5) in the flush water tank 26.

Also, as shown in FIG. 12, the window 176 bottom edge 106 is formed at a height position H6 from the bottom portion 172 of the float rise speed control tank 138. The float 58 is constituted so that the float 58 is subjected to buoyancy and starts to rise at a height position H7 from the bottom portion 172 of the float rise speed control tank 138 (as described above, the height position of H2 of the flush water level in the flush water tank 26). The height position H6 of the window 176 bottom edge 106 is set at a position higher than the height position H7 at which the float starts to rise.

Also, the water level height position at which the float 58 is raised and the reed switch 66 is ON is deemed to be the height position corresponding to the full water level WL0, and is set at a higher position than the bottom edge 106 of the window 176. Accordingly, in the present embodiment the float switch 34 reed switch 66 is also positioned at a higher position than the bottom edge 106 of the window 176. Thus even the damper portion 175 became inoperable for some reason such as becoming stuck or broken, and no water could be drained from the float rise speed control tank 138, such that flush water in the float rise speed control tank 138 stayed in the accumulated state, it would still be possible for the float 58 to descend slightly by lowering the flush water level in the float rise speed control tank 138 to the bottom edge of the window 176, and thereby to turn the reed switch 66 OFF, so that the water supply device 28 could supply water.

Flush water flowing in from the window 176 falls from a predetermined height H6 and bounces with force at the bottom portion 172, such that the float 58 is swayed laterally or vertically, releasing static frictional force so that the float 58 can be made to rise. If the float 58 can be shaken to release the static frictional force between the float 58 and the stem 56, the float 58 can be made to oppose this static frictional force between this float 58 and the stem 56 and rise (whereby dynamic friction force is less than static frictional force), and the float 58 can more easily be made to rise smoothly.

A deflector 181 forming an outward extending and downward slope from the bottom edge 106 of the window 176 is attached to the bottom edge 106 of the window 176. The deflector 181 has the width of the entire opening of the window 176, and forms a panel-shaped sloped portion. The deflector 181 forms a sloped path extending diagonally downward from the bottom edge 106 of the window 176.

The deflector 181 forms a hanging portion 181*a*, downwardly oriented at the leading edge portion of the deflector 181, a flat panel portion 181*b* extending diagonally downward from the base edge portion of the deflector 181, and a curved portion 181*c*, smoothly connecting between the flat panel portion 181*b* and the hanging portion 181*a*.

The top surface of the deflector 181 flat panel portion 181*b* forms a flow path conducting flush water from the top surface into the float rise speed control tank 138. The flat panel portion 181*b* forms a relatively flat sloped surface rising from the leading edge portion of the deflector 181 toward the base edge portion. Note that seen in a cross section through the sloped direction of the deflector 181, the deflector 181 may be formed in a straight line flat panel shape from the leading edge portion to the base edge portion of the deflector 181, or may be formed with an overall curved shape from the leading edge portion to the base edge portion of the deflector 181.

Because the deflector 181 extends diagonally downward from the bottom edge 106 of the window 176, when the horizontal water level of flush water in the flush water tank 26 rises gradually along the flat panel portion 181*b* at the height of the deflector 181, the deflector 181 is able to suppress the occurrence of a relatively large surface tension between the water surface of the horizontal flush water and the top surface of the diagonally downward-extending flat panel portion 181*b*. Therefore delays or variability in the timing due to the effects of surface tension at which flush water flows into the window 176 from the top surface of the deflector 181 can be restrained, and the problem of delays in the timing at which the water level inside the float rise speed control tank 138 rises can be reduced so that precision of float switch 34 activation timing can be maintained.

Note that compared to a case in which the a deflector 181 as described below is formed to extend from the window 176 bottom edge 106 in the horizontal direction, the deflector 181 in the present embodiment, by extending diagonally downward from the window 176 bottom edge 106, can still further reduce the effects of surface tension, and enable precise setting of the timing at which flush water flows into the window 176.

The deflector 181 forms a sloped path extending diagonally downward from the bottom edge 106 of the window 176 outward.

Therefore the reverse surface of the deflector 181 forms a return portion 181*d* which, using the deflector 181 flat panel portion 181*b*, curved portion 181*c*, and hanging portion 181*a*, covers so that small objects present along the center side wall 170*a* cannot rise up to the window 176 along the center side wall 170*a* together with a rising water level (water surface). Specifically, the return portion 181*d* is able to hold small objects in place so that in the small space formed between the flat panel portion 181*b* and the center side wall 170*a*, the small objects cannot rise any further with the rising water level. Small objects rising along the center side wall 170*a* when the water level in the flush water tank 26 rises get caught on the return portion 181*d* and are unable to rise any further. Small objects in this state of being caught by the deflector 181, with rise limited, drop along with the flush water upon the next flush water discharge, and are ejected from the discharge port 30.

Small objects thus by the deflector 181, restricted from rising, descend together with the flush water upon discharge in the next flush, and are ejected from the discharge port 30. In a laterally extending deflector 181, as well, a return portion 181*d* is formed by the reverse surface of the deflector 181, covering so that the small objects present along the center side wall 170*a* are prevented by the reverse surface of the deflector 181 from rising along center side wall 170*a* as the water level (water surface) rises.

The deflector 181 further forms a side wall portion 181*e* on the side portions of the flat panel portion 181*b* and the hanging portion 181*a*. The side wall portion 181*e* forms a flat panel shaped vertical wall, and the bottom edge of the side wall portion 181*e* is connected to both edges of the flat panel portion 181*b* and to both the left and right side edge portions of the hanging portion 181*a*.

The base portion side of the side wall portion 181*e* is connected to the center side wall 170*a* at the edges of both the left and right sides of the window 176. The side wall portions 181*e* are connected to the center side wall 170*a* from the center vicinity in the height direction of the window 176 up to the bottom edge 106 of the window 176. Hence the side wall portion 181*e* forms side walls on both the left and right sides of the deflector 181, and can be formed as a straight line conduit extending the conduit to the window 176 to the front side of the window 176. Hence small objects such as debris or other floating objects entering the float rise speed control tank 138 can be made less likely to become lodged in the drain portion 174, and can be discharged into the flush water tank 26 from the drain portion 174 along with a relatively large flush valve of flush water. By so doing, the side wall portion 181*e* can prevent flush water from flowing into the window 176 from the lateral side of the deflector 181, and even when small objects are subjected to surface tension and rise along the side walls 170*c*, the small objects can be made less likely to flow into the window 176 from the side walls 170*c*.

The float rise speed control tank 138 is formed so that when the flush water level inside the flush water tank 26 rises due to the supplying of flush water into the flush water tank 26 by the water supply device 28, and the flush water level reaches the window 176, the inflow of flush water in the flush water tank 26 to the float rise speed control tank 138 from the window 176 formed on the side above the float 58 bottom end part 59 results in a flush water level rise speed (water surface rise speed) in the float rise speed control tank 138 which is faster than the flush water level rise speed (water surface rise speed) in the flush water tank 26.

The flush water level rise speed in the float rise speed control tank 138 is a relatively fast rise speed, therefore the float 58 is subjected to an increased buoyancy matching the relatively fast level rise of the float 58.

The internal flush water level rise speed of the float rise speed control tank 138 can be changed by changing the surface area of its internal horizontal cross section. The float rise speed control tank 138 is able to control to a desired rise speed the rise speed of the flush water level on the inside of the float rise speed control tank 138 against the rise speed of the flush water level in the flush water tank 26 relative to the volume of flush water supplied per unit time by the water supply device 28.

Next, referring to FIGS. 8 through 15, the flushing operation (action) of a flush toilet according to a second embodiment of the invention is explained.

Also, the two flush modes executed by a flush toilet according to a second embodiment of the invention, i.e., the large flush mode and the small flush mode, except for fact that the amount by which the discharge valve device 32 discharge valve 54 is pulled up by the bead chain 52 is greater in the large flush mode than in the small flush mode, resulting in a longer flush water tank device 24 discharge port 30 release time, and that the dead water level (not shown) in the large flush mode is lower than in the small flush mode, the basic operations of the large flush mode and the small flush mode are the same, therefore only the large flush mode shall be explained.

As shown in FIGS. 9 through 13, in the standby state prior to start of discharge by the discharge valve device 32 (prior to flush start), the discharge valve device 32 discharge valve 54 is closing off the discharge port 30, and the initial water level inside the flush water tank device 24 is at full water level WL0. The float 58 is in a raised state, and the reed switch 66 is ON, while the water supply device 28 water supply valve 44 is in a closed state.

In this standby state, the drain hole float 175*b* is subjected to upward buoyancy by the air accumulated in the internal space thereof, and the damper-side seal portion 175*a* connected to the top surface of the drain hole float 175*b* contacts the drain-side seal portion 177, so that the drain portion 174 is in a sealed state. Therefore with the flow path in a blocked state, the storage area inside the float rise speed control tank 138 and the storage area inside the flush water tank 26 form respectively independent storage areas.

Next, a flush operation is started by user operation of the operating portion (not shown) or by a predetermined judgement of the control device 36; the discharge valve device 32 releases the flush water tank device 24 discharge port 30, discharge in the large flush mode to the toilet main body 2 of the flush toilet 101 by the discharge valve device 32 of the flush water tank device 24 is started, and the water level inside the flush water tank 26 starts to descend.

Flush water is discharged from the flush water tank 26 discharge port 30 to the conduit 9 of the toilet main body 2 and the water level inside the flush water tank 26 drops, while at the same time the control device 36, having received a start toilet flush request instruction, opens the water supply device 28 water supply valve 44 so that the spouting of a certain instantaneous flow volume into the flush water tank 26 from the spout port 46 is started.

As shown in FIG. 15, the drain hole float 175*b* drops when the water level in the flush water tank 26 drops to below the height of the damper portion 175. As the drain hole float 175*b* descends, contact between the damper-side seal portion 175*a* and the drain-side seal portion 177 is released, the drain portion 174 is placed in an open state, and flush water in the float rise speed control tank 138 start to flow out of the drain portion 174 into the flush water tank 26. Flush water inside the float rise speed control tank 138 flows from the drain portion 174 into the flush water tank 26, and the water level inside the float rise speed control tank 138 gradually drops. At this point, the flush water inside the float rise speed control tank 138 is at a higher position than the water level inside the flush water tank 26.

When the flush water level inside the float rise speed control tank 138 gradually drops, the height of the float 58 gradually drops along with the water level. The damper portion 175, by moving the damper-side seal portion 175*a* diagonally from the closed orientation in which the damper-side seal portion 175*a* seals the drain-side seal portion 177, changes the drain portion 174 to a relatively widely open orientation. When the damper-side seal portion 175*a* separates from the drain-side seal portion 177 and drops, the damper-side seal portion 175*a* descends along the diagonal rotary direction relative to the vertical down direction, along the rotation of the support arm 175*d* centered on the support point 175*c*. Thus the damper portion 175 rotates the damper-side seal portion 175*a* centered on the support point 175*c*, and fully separates the damper-side seal portion 175*a* from the drain-side seal portion 177, so that the drain portion 174 opening can be formed to be sufficiently large in a small movement distance.

When the height of the float 58 drops with the drop in the flush water level in the float rise speed control tank 138, the position of the magnet 68 also drops, therefore the reed switch 66 is turned OFF.

As shown in FIG. 15, the damper-side seal portion 175*a* separates from the drain-side seal portion 177 and moves diagonally downward, therefore even if the damper-side seal portion 175*a* is still positioned under the drain portion 174, the drain portion 174 downward spreading opening part becomes relatively wide, and the drain portion 174 is opened as a relatively large opening. Hence small objects such as debris or other floating objects in the float rise speed control tank 138 can be made less likely to lodge in the drain portion 174, and can be made to flow out from the drain portion 174 into the flush water tank 26 with a large flow volume of flush water. Because the drain portion 174 is formed as a relatively large opening, the flow of flush water flowing out from the 174 can be formed to be relatively strong, and small objects can be directed to the drain portion 174 side in the float rise speed control tank 138, and made to more easily flow out from the drain portion 174.

Next, when the water level inside the flush water tank 26 drops to the dead water level (not shown), the discharge valve device 32 closes the flush water tank 26 discharge port 30. Discharge into the toilet main body 2 of the flush toilet 101 by the discharge valve device 32 in the large flush mode is thus completed. At this time, the float 58 is in a dropped state and the float switch 34 reed switch 66 is in an OFF state, so the water supply valve 44 is released, supply of water to the flush water tank 26 by the water supply device 28 is continued, and the water level inside the flush water tank 26 rises from the dead water level (not shown). Because water supplied to the flush water tank 26 by the water supply device 28 is a fixed supply water flow volume (fixed instantaneous flow volume), the flush water level inside the flush water tank 26 rises at essentially a first speed. The water level rise speed is obtained by dividing the flush valve of water supplied from the spout port 46 by the cross sectional area of the horizontal cross section of the flush water tank 26.

As shown in FIGS. 10 through 13, furthermore, the drain hole float 175*b* rises when the supply of water from the water supply device 28 is continued and the water level reaches the height of the drain hole float 175*b*. An upward buoyancy is produced on the drain hole float 175*b* by the accumulation of air in the downward facing space on the drain hole float 175*b*; the damper-side seal portion 175*a* and the drain-side seal portion 177 are brought in contact, sealing the drain portion 174. Thus even if the flush water level in the flush water tank 26 has risen up to the outer circumference of the lower portion of the float rise speed control tank 138, the drain portion 174 is sealed, therefore in the float rise speed control tank 138 an essentially empty state is maintained, in which no flush water is stored. I.e., the interior of the float rise speed control tank 138 forms an empty internal space in which no flush water is stored, and since there is no flush water present, the float 58 is in the most descended position.

When the supply water from the water supply device 28 or the discharge water from the hand-washing device flows into the center vicinity area in the flush water tank 26, small objects flowing into the flush water tank 26 (or present in the flush water tank 26) are flushed out toward the flush water tank 26 inner side wall 26*a*, which is still further outside than the center side wall 170*a*, and are attracted to the inner side wall 26*a* of the flush water tank 26 by surface tension. For example, the small objects are floating on the water surface along the inner side wall 26*a*. Before the flush water level reaches the height of the window 176 during supply of water, most of the small objects are flushed toward the inner side wall 26*a*, and are floating on the water surface along the inner side wall 26*a*. Also, even in cases when the flush water level reaches the height of the window 176 during supply of water, most of the small objects are flushed toward the inner side wall 26*a*, and are floating on the water surface along the inner side wall 26*a*. Thus even when small objects are present along the inner side wall 26*a* due to surface tension, they have difficulty moving along the wall surface from the inner side wall 26*a* to the window 176, therefore small objects have difficulty flowing into the window 176 and plugging the interior of the float rise speed control tank 138.

Also, small objects can be restrained from flowing into the interior of the float rise speed control tank 138 and causing operational failures of the float 58 caused by small objects becoming lodged or tangled between the float 58 and the stem 56.

As described above, small objects are basically easily flushed toward the inner side wall 26*a*, but in cases where small objects are subjected to surface tension and present at positions following the vertical wall of the float rise speed control tank 138 when the water surface in the flush water tank 26 is rising, small objects present so as to follow the center side wall 170*a* side are caught on the return portion 181*d*, and are prevented from rising any further relative to the rise of the water surface, so they have difficulty flowing into the window 176. Thus small objects present in a manner that they are pulled to the center side wall 170*a* can be made less likely to flow into the window 176 formed on the center side wall 170*a*.

When the water surface in the flush water tank 26 is rising and small objects are subjected to the action of surface tension and present at positions along the float rise speed control tank 138 vertical walls 170, the small objects present along the side wall 170*c* side can, by the side wall portion 181*e*, be made less likely to flow into the window 176 from the side wall 170*c* side. The side wall portion 181*e* can be used to make it difficult for a flow to form from the side wall 170*c* side toward the inside of the window 176.

When the flush water level in the flush water tank 26 further rises and reaches the bottom edge 106 of the window 176, flush water in the flush water tank 26 flows into the interior of the float rise speed control tank 138 from the window 176 opening toward the center side of the flush water tank 26. When the horizontal flush water level in the flush water tank 26 gradually rises along the flat panel portion 181*b*, a large surface tension is restrained from occurring between the horizontal flush water surface and the diagonally downwardly extending flat panel portion 181*b* top surface, and flush water inflow into the window 176 is started immediately, with no delay, when the flush water level reaches the bottom edge 106.

Since a certain supply flow volume supplied from the water supply device 28 flows all at once from the window 176 formed as a large opening in the float rise speed control tank 138 into the float rise speed control tank 138, the rise speed of the flush water level inside the float rise speed control tank 138 becomes larger than the rise speed of the flush water level in the flush water tank 26. At this point the surface area of the horizontal cross section of the water storable area S1 inside the float rise speed control tank 138 is set to a range of 1/30 to 1/3, and preferably a range of 1/25 to 1/20, therefore even if the same fixed flow volume of supply water flows into the float rise speed control tank 138, the rise speed of flush water inside the float rise speed control tank 138 becomes faster than the outside rise speed. The rise speed of the flush water level inside the float rise speed control tank 138 is set to a range of 3 to 23 times the rise speed of the flush water level inside the flush water tank 26, and preferably a range of 15 to 23 times thereof.

The flush water level rise speed in the float rise speed control tank 138 is a relatively fast rise speed, therefore the float 58 is subjected to an increased buoyancy and to lifting energy in the rising direction matching the relatively fast level rise of the float 58. Even if the float switch 34 float 58 is subjected to forces trying to impede its movement (or such forces occur), such as static frictional force relative to the stem 56 or adhesion of air bubbles, the float 58 is subjected to an increased buoyancy and lifting energy or the like and to a lifting energy or the like capable of overcoming the forces acting to impede movement between float 58 and the stem 56 so that it rises without a time lag in response to a rise in the water level relative to the stem 56.

When the flush water level reaches the window 176 when water is supplied, flush water drops all at once from the window 176 formed above the bottom edge part of the float 58, into the empty float rise speed control tank 138. At this point, flush water dropping into the float rise speed control tank 138 splashes back inside the float rise speed control tank 138, further causing turbulence and creating waves in the water surface, causing the float 58 to sway up and down as well as in the front to back and left to right directions, so that the float 58 is subjected to a force sufficient to overcome the forces acting to impede its movement, such as static frictional force between this float 58 and the stem 56, and the static frictional force between the float 58 and the stem 56 is released, thereby smoothly raising the float 58 relative to the stem 56.

After the float 58 has started to rise, in association with the rise of the flush water level inside the float rise speed control tank 138, the float 58 continues to be subjected to forces (e.g., buoyancy) capable of overcoming the forces acting to impede its movement, such as static frictional force between the float 58 and the stem 56, and the float 58 is made to rise smoothly relative to stem 56. When the water level in the flush water tank 26 reaches water level WL0 and the float 58 rises to a height position matching the full water level WL0, the position of the magnet 68 is also moved up along with the upward movement of the float 58, and the reed switch 66 changes from the OFF state to the ON state. The float switch 34 reed switch 66 issues a stop water supply signal to the control device 36, and the control device 36 having received this closes the water supply valve 44 so that water to the spout port 46 is stopped. The flush water level in the flush water tank 26 is thus maintained at a predetermined full water level WL0. When the flush water level in the flush water tank 26 reaches the full water level WL0 and the water supply valve 44 is closed, the series of flush water tank device 24 flush operations is completed, and the device returns to a standby state.

In the flush toilet 101 according to the above-described second embodiment of invention, the float rise speed control tank 138 is formed so that during water supplying when the flush water level in the flush water tank 26 rises and reaches the window 176, the flush water in the flush water tank 26 flows from the window 176 formed above the float 58 bottom edge part 59 into the float rise speed control tank 138. The rise speed of the flush water level inside the float rise speed control tank 138 is increased more than the rise speed of the flush water level inside the flush tank 26. The float 58 is therefore subjected to a buoyancy force, which is increased in response to the increased water level rise speed. Therefore even if the float switch 34 float 58 is subjected to forces acting to impede its movement, such as the occurrence of static frictional force relative to the stem 56 or adherence of bubbles, buoyancy acting on the float 58 is increased to the point that it overcomes the force acting to impede movement between the float 58 and the stem 56, thus making it easier for the float 58 to rise relative to the stem 56. It is thus possible to prevent a situation in which movement of the float 58 on the stem 56 is impeded even though the flush water level is rising, such that the float switch 34 cannot operate at the proper timing, delaying the timing at which the water supply is stopped.

Also, if the flush water level reaches the window 176 during supply of water, flush water drops into the float rise speed control tank 138 from the window 176 formed over the float 58, thereby creating turbulence on the water surface and swaying the float 58 so that the float 58 is subjected to a force capable of overcoming the static frictional force between the float 58 and the stem 56, thereby facilitating release of the static frictional force between the float 58 and the stem 56 so that the float 58 can more easily rise relative to the stem 56. Thus situations in which movement of the float 58 on the stem 56 is impeded so the float switch 34 cannot operate at the proper timing, and the timing for stopping water supply is delayed, even though the flush water level is rising, can be constrained. Therefore the float switch 34 can be reliably activated, and the supply of water reliably stopped.

Using the flush toilet 101 according to the present embodiment, small objects such as debris or floating objects etc. entering the flush water tank 26 can be easily collected by surface tension on the inner side wall 26*a* of the flush water tank 26. Therefore by forming the window 176 of the float rise speed control tank 138 at the center side wall 170*a* of the float rise speed control tank 138 in the center area side of the flush water tank 26, small objects such as debris or floating objects etc. collecting on the inside wall surface of the flush water tank 26 can be restrained from penetrating into the window 176 at the center area side of the flush water tank 26.

Also, using the flush toilet 101 according to the present embodiment, even when small objects such as floating objects or the like which have entered into the flush water tank 26 are present along the outside wall surface (e.g. the center side wall 170*a*) under the window 176 of the float rise speed control tank 138 due to surface tension, the deflector 181 extends outward from the bottom edge 106 of the window 176, therefore small objects rising with the rise in the water level in the flush water tank 26 can be caught by the deflector 181, and not permitted to rise from below the window 176 up to the height of the window 176. Therefore small objects present at positions along the outer wall surface below the window 176 of the float rise speed control tank 138 can be restrained from penetrating into the window 176 of the float rise speed control tank 138.

Also, using the flush toilet 101 according to the present embodiment, even when small objects such as floating objects or the like which have entered into the flush water tank 26 are present along the outside wall surface (e.g. the center side wall 170*a*) under the window 176 of the float rise speed control tank 138 due to surface tension, the deflector 181 extends outward and diagonally downward from the bottom edge 106 of the window 176, therefore small objects rising along with the rise in the water level in the flush water tank 26 can be caught by the deflector 181, and not permitted to rise from below the window 176 up to the height of the window 176. Therefore small objects present at positions along the outer wall surface (e.g., the center side wall 170*a*) below the window 176 of the float rise speed control tank 138 can be restrained from penetrating into the window 176 of the float rise speed control tank 138.

Also, when the flush water level inside the flush water tank 26 rises gradually at the deflector 181 height, the deflector 181 extends outward and diagonally downward from the bottom edge 106 of the window 176, therefore a relatively large surface tension can be restrained from occurring between the horizontal flush water surface and the top surface of the diagonally downwardly extending deflector 181. Delays or variability due to the effects of surface tension in the timing at which flush water flows into the window 176 from the top surface of the deflector 181 can thus be restrained, and the problem of delays in the timing at which the water level inside the float rise speed control tank 138 rises can be reduced so that precision of float switch 34 activation timing can be maintained.

Also, in the flush toilet 101 according to the present embodiment, the attaching opening portion of the float rise speed control tank 138, attached to the stem 56, comprises a return portion 173*c* for restraining the tilt of the float rise speed control tank 138 relative to the stem 56, therefore the tilt of the float rise speed control tank 138 can be kept essentially horizontal, and tilting of the flush water level in the float rise speed control tank 138 can be restrained, so that precise operational timing of the float switch 34 can be maintained.

Also, using the flush toilet 101 according to the present embodiment, the float rise speed control tank 138 damper portion 175 has an open orientation in which the drain portion 174 is relatively widely opened by moving the damper-side seal portion 175*a* diagonally from the closed orientation, therefore the drain portion 174 can be opened relatively greatly, and small objects such as floating objects or the like entering into the float rise speed control tank 138 can be made less likely to become stuck in the drain portion 174, and can be made to discharge into the flush water tank 26 from the drain portion 174 together with a comparatively large flow volume of flush water. Therefore even if small objects enter into the float rise speed control tank 138, float switch 34 operational failures and blockage of the drain hole portion 174 can be constrained, and reliability of the float rise speed control tank 138 can be improved.

Finally, a variant example of the flush toilet 1 according to a first embodiment and/or the flush toilet 101 according to a second embodiment of the invention are explained.

As one variant example, for example, a deflector 181 extending toward the outside from the bottom edge 106 of the window 76 in the flush toilet 101 according to the second embodiment and forming a diagonally downwardly dropping slope may be attached to all or part of the window 76 formed over essentially the entire circumference of the float rise speed control tank 38, as in the flush toilet 1 according to the first embodiment of the invention.

As another variant example, a deflector 181 extending toward the outside from the bottom edge 106 of the window 76 in the flush toilet 101 according to the second embodiment and forming a diagonally downwardly dropping slope may, for example, be attached to all or part of the multiple windows 76 formed in the multiple vertical walls 70 of the float rise speed control tank 38, as in the flush toilet 1 according to the first embodiment of the invention.

As another variant example, a flush toilet may be constituted, for example, in which the drain portion 174 of the float rise speed control tank 138 is applied to the flush toilet 101 according to the second embodiment, in place of the float rise speed control tank 38 drain portion 74 structure in flush toilet 1 according to the first embodiment.

As still another variant example, a flush toilet may be constituted, for example, by combining a part or multiple instances of the above-described or other variant examples.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing with flush water, the flush toilet comprising:

a toilet main body;

a flush water tank configured to store flush water to flush the toilet main body;

a water supply device configured to supply flush water into the flush water tank;

a float switch disposed in the flush water tank, the float switch including:

a shaft disposed in the flush water tank; and a float configured to move up and down along the shaft in response to a rise or drop of a flush water level; and the float switch being configured to issue a stop water supply signal when the float rises to a predetermined position along the shaft in response to a rise of the flush water level;

a control device configured to control supplying the flush water by the water supply device after receiving the stop water supply signal issued by the float switch; and a float rise speed control tank disposed in the flush water tank, the float rise speed control tank being configured to surround an outside of at least a lower portion of the float;

wherein the float rise speed control tank includes a drain hole and a window; and the float rise speed control tank is configured to increase a rise speed of the flush water level in the float rise speed control tank more than a rise speed of the flush water level in the flush water tank when the flush water is supplied into the flush water tank by the water supply device and the flush water level in the flush water tank rises and reaches the window so that the flush water in the flush water tank flows into the float rise speed control tank through the window, and wherein the float rise speed control tank further includes a deflector extending outward and diagonally downward from a bottom edge of the window.

2. The flush toilet according to claim 1, wherein the float rise speed control tank includes windows which are formed at approximately a same height position to each other.

3. The flush toilet according to claim 2, wherein the windows on the float rise speed control tank are formed over approximately an entire circumference of the float rise speed control tank.

4. The flush toilet according to claim 1, wherein a drain hole float is provided on the drain hole on the float rise speed control tank, the drain hole float being configured to close off the drain hole by using a buoyancy which the drain hole float receives when the flush water level in the flush water tank rises.

5. The flush toilet according to claim 1, wherein the rise speed of the flush water level in the float rise speed control tank is set to a range from 7 mm/s to 100 mm/s.

6. The flush toilet according to claim 1, wherein the drain hole is formed on a bottom of the float rise speed control tank, the drain hole having a size in a range of 1 mm to 15 mm in diameter.

7. The flush toilet according to claim 1, wherein the float rise speed control tank is provided with an attachment opening portion attached to the shaft of the float at a bottom portion of the float rise speed control tank; and the attachment opening portion includes a tilt suppressing portion configured to suppress tilt of the float rise speed control tank relative to the shaft.

8. A flush toilet configured to discharge waste by flushing with flush water, the flush toilet comprising:

a toilet main body;

a flush water tank configured to store flush water to flush the toilet main body;

a water supply device configured to supply flush water into the flush water tank;

a float switch disposed in the flush water tank, the float switch including:

a shaft disposed in the flush water tank; and a float configured to move up and down along the shaft in response to a rise or drop of a flush water level; and the float switch being configured to issue a stop water supply signal when the float rises to a predetermined position along the shaft in response to a rise of the flush water level;

a control device configured to control supplying the flush water by the water supply device after receiving the stop water supply signal issued by the float switch; and a float rise speed control tank disposed in the flush water tank, the float rise speed control tank being configured to surround an outside of at least a lower portion of the float;

wherein the float rise speed control tank includes a drain hole and a window; and the float rise speed control tank is configured to increase a rise speed of the flush water level in the float rise speed control tank more than a rise speed of the flush water level in the flush water tank when the flush water is supplied into the flush water tank by the water supply device and the flush water level in the flush water tank rises and reaches the window so that the flush water in the flush water tank flows into the float rise speed control tank through the window, and wherein the float rise speed control tank is disposed on a center area side of the flush water tank.

9. The flush toilet according to claim 8, wherein the float rise speed control tank further includes a deflector extending outward from a bottom edge of the window.

10. The flush toilet according to claim 8, wherein the float rise speed control tank further includes a deflector extending outward and diagonally downward from a bottom edge of the window.

11. A flush toilet configured to discharge waste by flushing with flush water, the flush toilet comprising:

a toilet main body;

a flush water tank configured to store flush water to flush the toilet main body;

a water supply device configured to supply flush water into the flush water tank;

a float switch disposed in the flush water tank, the float switch including:

a shaft disposed in the flush water tank; and a float configured to move up and down along the shaft in response to a rise or drop of a flush water level; and the float switch being configured to issue a stop water supply signal when the float rises to a predetermined position along the shaft in response to a rise of the flush water level;

a control device configured to control supplying the flush water by the water supply device after receiving the stop water supply signal issued by the float switch; and a float rise speed control tank disposed in the flush water tank, the float rise speed control tank being configured to surround an outside of at least a lower portion of the float;

wherein the float rise speed control tank includes a drain hole and a window; and the float rise speed control tank is configured to increase a rise speed of the flush water level in the float rise speed control tank more than a rise speed of the flush water level in the flush water tank when the flush water is supplied into the flush water tank by the water supply device and the flush water level in the flush water tank rises and reaches the window so that the flush water in the flush water tank flows into the float rise speed control tank through the window, and wherein the float rise speed control tank includes:

an opening and closing mechanism configured to open and close the drain hole, the opening and closing mechanism having a closed orientation in which the drain hole is closed off by a seal; and an open orientation in which the drain hole is opened by moving the seal diagonally from the closed orientation; and the opening and closing mechanism further includes:

a support arm configured to support a seal and a drain hole float configured to cause buoyancy to act on the seal;

a support arm attaching portion configure to attach the support arm; and a raised portion configured to project toward a gap between the support arm and the support arm attaching portion so as to suppress contact between the support arm and the support arm attaching portion.

* * * * *